US007013505B2

(12) United States Patent
Martin

(10) Patent No.: US 7,013,505 B2
(45) Date of Patent: Mar. 21, 2006

(54) PORTABLE COMBINATION BEDSIDE CO-SLEEPER

(75) Inventor: Bruce Martin, Malibu, CA (US)

(73) Assignee: Arms Reach Concepts, Malibu, CA (US)

( * ) Notice: Subject to any disclaimer, the term of this patent is extended or adjusted under 35 U.S.C. 154(b) by 0 days.

(21) Appl. No.: 10/642,467

(22) Filed: Aug. 14, 2003

(65) Prior Publication Data

US 2005/0034232 A1 Feb. 17, 2005

(51) Int. Cl.

| | |
|---|---|
| ***A47D 7/04*** | (2006.01) |
| ***A47D 7/02*** | (2006.01) |
| ***A47D 13/06*** | (2006.01) |

(52) U.S. Cl. ..... 5/95; 5/98.1; 5/99.1

(58) Field of Classification Search ..... 5/95, 5/93.1, 93.2, 98.1, 99.1, 100, 655, 424–428, 5/11

See application file for complete search history.

(56) References Cited

U.S. PATENT DOCUMENTS

| | | | | | |
|---|---|---|---|---|---|
| 2,548,769 | A | | 4/1951 | Burgin | |
| 2,691,176 | A | | 10/1954 | Saldana | |
| 4,070,716 | A | * | 1/1978 | Satt et al. | 5/99.1 |
| 4,811,437 | A | * | 3/1989 | Dillner et al. | 5/99.1 |
| 5,148,561 | A | | 9/1992 | Tharalson et al. | |
| 5,172,435 | A | | 12/1992 | Griffin et al. | |
| 5,293,655 | A | | 3/1994 | Van Winkle et al. | |
| 5,339,470 | A | | 8/1994 | Shamie | |
| 5,553,336 | A | | 9/1996 | Mariol | |
| 5,581,827 | A | | 12/1996 | Fong et al. | |
| 5,711,040 | A | * | 1/1998 | Huang | 5/99.1 |
| 5,845,349 | A | * | 12/1998 | Tharalson et al. | 5/99.1 |
| 6,112,347 | A | * | 9/2000 | Tharalson et al. | 5/95 |
| 6,148,456 | A | * | 11/2000 | Tharalson et al. | 5/99.1 |
| 6,550,082 | B1 | * | 4/2003 | Tharalson et al. | 5/95 |
| 6,578,211 | B1 | * | 6/2003 | Tharalson et al. | 5/93.2 |
| 6,704,949 | B1 | * | 3/2004 | Waldman et al. | 5/93.1 |
| 6,877,173 | B1 | * | 4/2005 | Tharalson et al. | 5/93.2 |
| 2003/0177574 | A1 | * | 9/2003 | Waldman | 5/93.1 |
| 2003/0196264 | A1 | * | 10/2003 | Tharalson et al. | 5/95 |
| 2004/0181873 | A1 | * | 9/2004 | Waldman et al. | 5/95 |
| 2005/0034232 | A1 | * | 2/2005 | Martin | 5/95 |

* cited by examiner

*Primary Examiner*—Robert G. Santos
(74) *Attorney, Agent, or Firm*—Reed Smith, LLP

(57) ABSTRACT

A first playpen enclosure that converts easily to a bassinet, changing table or bed-side crib or "co-sleeper" that attaches securely to the parents' bed. A second enclosure support system maintains a padded enclosure and rigid floor panel at one or more predetermined levels below the top of the playpen to form the bassinet and co-sleeper. The second enclosure has a back, two sides, a bottom and a front flap that converts into a front wall for use in the bassinet mode and overhangs the front horizontal rail for use in the co-sleeper mode. The upper front corners are segmented into a movable section and a fixed section to facilitate lowering the front horizontal rail to at least one lower second position to accommodate various parental bed heights. Extensions of the fixed section are affixed to the front vertical rails and accept the movable sections in several positions to secure the rail in the second positions. The support means, padded enclosure and rigid floor panel complete the changing table with the edges of the front flap secured to the edges of the side walls. The playpen is placed adjacent the parents' bed with the front flap extended over the bed for use as a co-sleeper. Means are provided to secure loose flap material to the front of the co-sleeper. For co-sleeper use, reinforcing straps secure the unit to the parents' bed and prevent movement. The unit is easily folded with its components into a compact carrying case for transport or storage.

25 Claims, 17 Drawing Sheets

FIG. 1
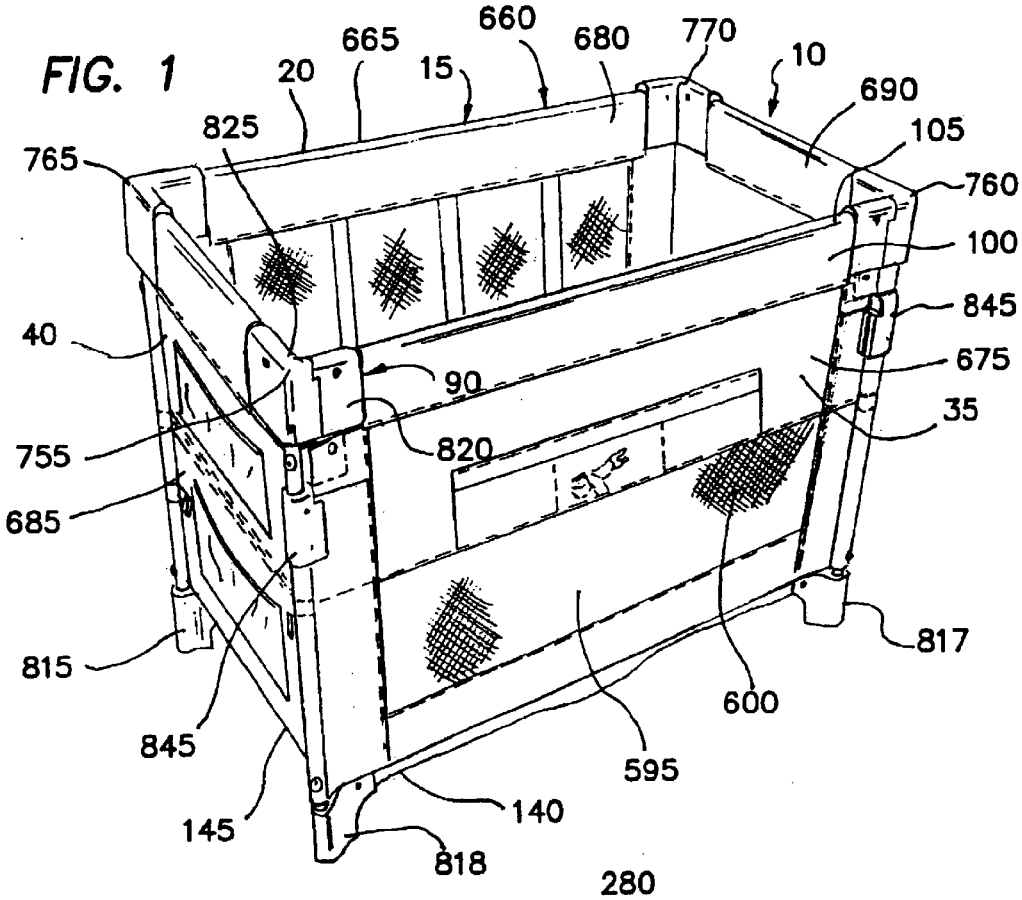
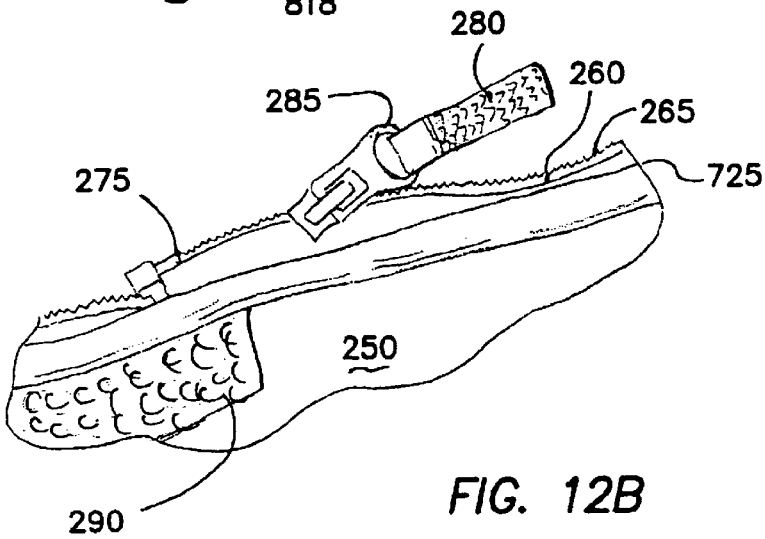
FIG. 12B

FIG. 6
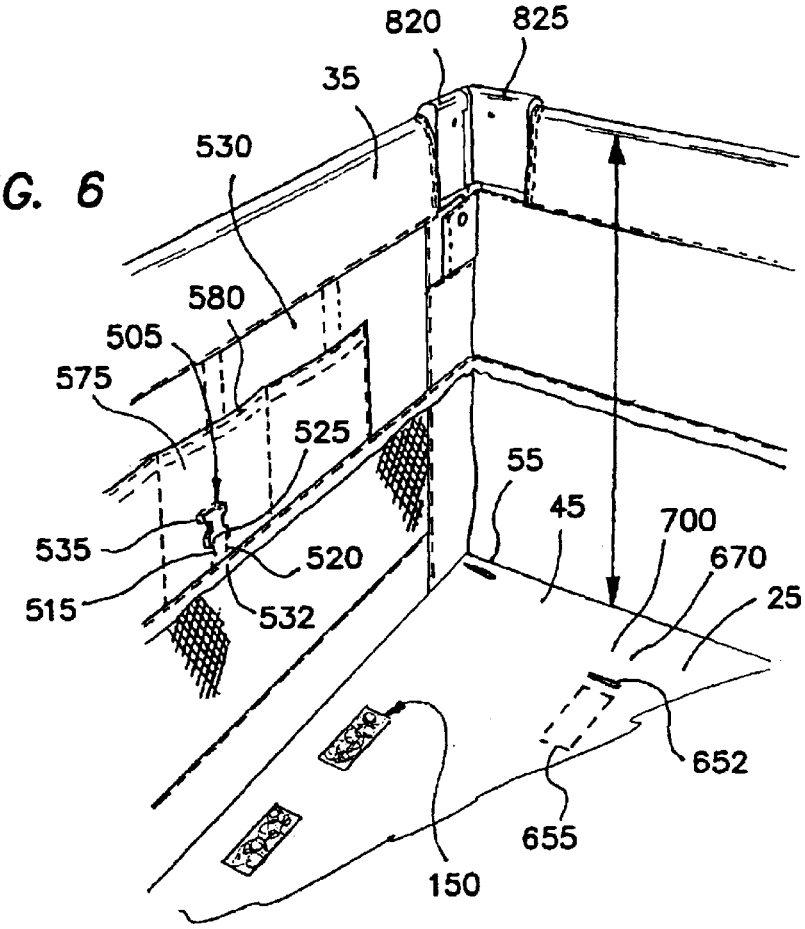
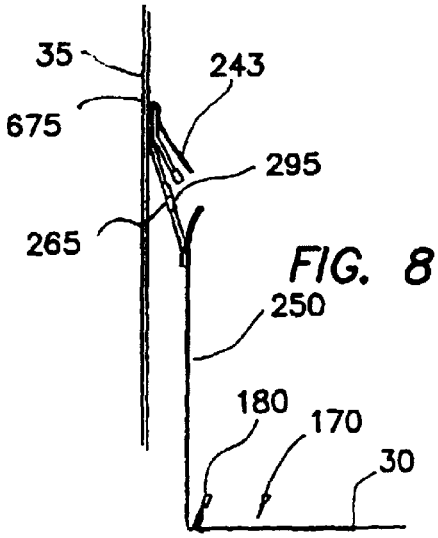
FIG. 8
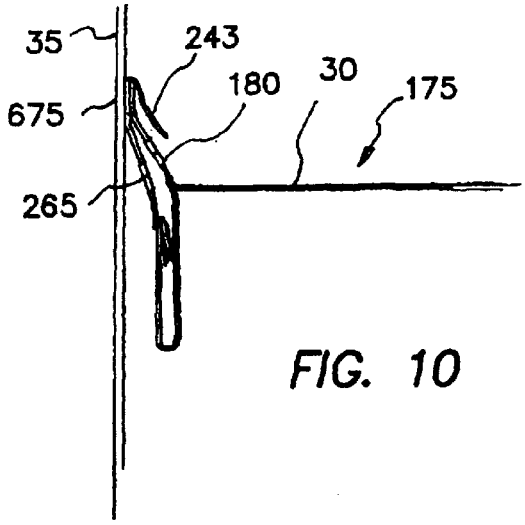
FIG. 10

PORTABLE COMBINATION BEDSIDE CO-SLEEPER

FIELD OF INVENTION

The instant invention relates to the field of convertible units for use with babies and very young children; in particular to units which may be easily converted to a play yard, bassinet, changing table, or child's bed-side sleeping enclosure, hereinafter referred to for convenience as a "co-sleeper", that attaches securely to the parents' bed.

BACKGROUND OF THE INVENTION

Play yards and playpens for babies and young children are well known and many variations have been marketed over the years. Low portable cribs have also been used as playpens. For reasons of economy and space conservation it has been practical to find additional uses for playpens, such as bassinets and changing tables if such additional uses can be accomplished by means of easy alterations or adjustments that are reversible.

In U.S. Pat. No. 2,548,769, Burgin teaches a crib that can be lowered for use as a playpen. Shamie, in U.S. Pat. No. 5,339,470 teaches a portable playpen that can be converted to a changing or dressing table. In U.S. Pat. No. 5,553,336, Mariol adds an upper level to a playpen to provide a bassinet. The short legs of the upper level are inserted into openings in the top of the vertical supports of the playpen. Saldana, U.S. Pat. No. 2,691,176, teaches a unit designed for home and travel that may be used as a support for a playpen, bassinet or baby chair. U.S. Pat. No. 5,581,827 to Fong et al. discloses a foldable playpen unit. Bedside cribs that attach to the parents' bed were known at the turn of the century (U.S. Pat. Nos. 5,548,005; 620,069; 1,138,451; 1,283,169; 1,267,244)but fell out of favor for many years. Recently there has been a resurgence in the practice of having babies sleep adjacent the parents' bed. Such bed-side cribs are taught in U.S. Pat. No. 5,172,435 to Griffin et al.; U.S. Pat. No. 5,293,655 to Van Winkle et al. and to Tharalson et al. as U.S. Pat. No. 5,148,561.

It is an objective of the present invention to provide a single unit that, with quick and easy adjustments, can be adapted for several different purposes, including a playpen, a bassinet, a changing table and a co-sleeper.

It is another objective of the present invention to provide a unit that can be converted to a co-sleeper that is an improvement over the prior art, that rests on four legs, with or without attached wheels, will not lift, tip or buck and that is secured to the parents' bed with a safety strap so it cannot slide away from the bed.

It is a further objective to provide a co-sleeper that is adaptable to both U.S. and European bed heights, including means of securing the co-sleeper to beds of both heights. Means should be provided to permit the co-sleeper mattress to be positioned at heights within the co-sleeper suitable for positioning adjacently to both U.S. and European bed surfaces. Likewise, means for adjusting the mattress cover to minimize any excess fabric when switching between U.S. and European mattress height adjustments should be provided.

Another objective of the present invention is to allow conversion to a co-sleeper while still maintaining the stability of the unit by the repositioning of the front horizontal rail. Such repositioning should provide for both U.S. and European bed heights.

It is yet a further objective of the present invention that the co-sleeper be adjacent the parents' bed but at a level below the level of the parents' bed. Another objective of the present invention is to provide means to adjust the height of the co-sleeper to conform to the different bed heights. A still further objective of the present invention is to provide a secure washable enclosure for an infant of small child.

Another objective of the present invention is to provide a playpen in which an infant or small child can be tended to by a care-giver that is physically handicapped. A further objective of the present invention is to provide a unit that folds easily for storage and transport.

It is still a further objective of the invention to provide a playpen with a floor which can withstand repeated jumping and rough play by an infant or small child without sagging or the risk of breakage. The floor should be constructed of a mesh material to prevent accidental suffocation of an infant or small child who might find his or her way underneath the co-sleeper mattress.

It is yet a further objective to provide an easily convertible playpen that includes strong, secure hinging mechanisms for the playpen support members. Such mechanisms should lock the members securely in place and yet be simple and easy to release when required. These mechanisms should be padded and enclosed so that movable metallic parts are not accessible to an infant or small child's fingers.

It is still a further objective of the invention to provide for simple adjustments to the height of the front wall of the co-sleeper while preventing injury to any small fingers that may be inserted into the openings in the adjustment mechanism.

It is another objective to minimize any loose fabric associated with the co-sleeper mattress that could conceivably cause asphyxiation of an infant or small child.

Other features and advantages of the invention will be seen from the following description and drawings.

SUMMARY OF THE INVENTION (1) The present invention is a portable combination bedside co-sleeper convertibly adapted for use as a bassinet, changing table and playpen. The co-sleeper, includes an enclosure that has an open top, a floor, a mattress support panel, a front wall, and at least one surrounding wall connected to the front wall. The floor has a top surface, a bottom surface and surrounding side edges and is attached to the front wall and the surrounding wall at the surrounding side edges. The mattress support panel has an upper surface, a lower surface, an outer perimeter and is removably attached to the front wall and the surrounding wall at the outer perimeter and is spaced upwardly from the floor. A mattress pad is provided. The mattress pad has an upper surface, a lower surface and is sized and shaped to fit slidably between the front wall and the surrounding wall.

Means are provided for reversibly lowering a height of at least a portion of the front wall, from a first position at the top to at least one second position below the top. A securing strap assembly is provided for securing the co-sleeper to a parental bed. When the front wall is raised to the first position, the co-sleeper is usable as a bassinet; and when the front wall is then lowered to one of its second positions, the co-sleeper is usable as a changing table. When the securing strap assembly is properly positioned and the co-sleeper is secured to the parental bed it will serve as a co-sleeper.

(2) In a variant of the invention, the floor further includes a series of first reinforcing straps. The first reinforcing straps are located upon the bottom surface of the floor. At least two of the first reinforcing straps are attached to the enclosure.

(3) In another variant, the floor further includes at least two fastening portions extending outwardly from the first reinforcing straps and attaching to the enclosure and at least two securing portions. The securing portions attach the fastening portions to a lower edge of the front wall and to a lower edge of the surrounding wall.

(4) In still another variant, the floor further includes means for removably securing the lower surface of the mattress pad to the top surface of the floor.

(5) In yet another variant of the invention, the mattress support panel is formed of mesh material.

(6) In still another variant, the mattress support panel further includes a series of reinforcing panels. The reinforcing panels are attached to the upper surface of the mattress support panel. A series of second reinforcing straps is provided. The second reinforcing straps are attached to the lower surface of the mattress support panel.

(7) In another variant, spacing of the mattress support panel upwardly from the floor is adjustable between a first, lower position to at least one second higher position, thereby permitting the mattress pad to be maintained at at least two different heights relative to an upper mattress surface of the parental bed.

(8) In still another variant, the mattress support panel is removably attached to the front wall and the surrounding wall at the outer perimeter using a first zipper.

(9) In yet another variant, means are provided for securing an openable end of the first zipper.

(10) In yet a further variant of the invention, the means for securing an openable end of the first zipper includes a first reversibly separable securing tab. The first securing tab attaches to a zipper pull of the first zipper. A zipper pull cover is provided. The zipper pull cover has a side edge, a top surface, a bottom surface and a first reversibly separable pad attached to the bottom surface. The zipper pull cover is attached at the side edge to an inner surface of either the front wall or the surrounding wall adjacent the openable end of the first zipper. A second reversibly separable attachment pad is attached to the upper surface of the mattress support panel adjacent the openable end of the first zipper. When the first zipper is in a closed position, the first reversibly separable pad of the zipper pull cover will attach to the first securing tab and the second reversibly separable attachment pad, thereby preventing easy opening of the first zipper.

(11) In still a further variant, a flexible covering for an upper portion of the first zipper is provided to prevent injury to an infant or small child.

(12) In another variant, the mattress support panel includes a surrounding edge panel. The surrounding edge panel extends upwardly from the outer perimeter for a first predetermined distance and has an upper edge. A second zipper is provided. The second zipper removably attaches the surrounding edge panel to the front wall and the surrounding wall at the upper edge. When the second zipper attaches the upper edge to the front wall and the surrounding wall the mattress support panel will be located at the first lower position. When the first zipper also attaches the outer perimeter to the front wall and the surrounding wall the mattress support panel will be disposed at one of the second higher positions.

(13) In still another variant, means are provided for securing an openable end of the second zipper.

(14) In yet another variant, the means for securing an openable end of the second zipper includes a second reversibly separable securing tab. The second securing tab attaches to a zipper pull of the second zipper. The zipper pull cover is attached at the side edge to an inner surface of either the front wall or the surrounding wall adjacent the openable ends of the first zipper and the second zipper. A third reversibly separable attachment pad attaches adjacent the upper edge of the surrounding edge panel adjacent the openable end of the second zipper. When the second zipper is in a closed position, the first reversibly separable pad of the zipper pull cover will attach to the second securing tab and the third reversibly separable attachment pad, thereby preventing easy opening of the second zipper.

(15) In a further variant, the flexible covering is provided for an upper portion of the second zipper to prevent injury to an infant or small child.

(16) In still a further variant of the invention, the mattress support panel includes means for removably securing the lower surface of the mattress pad to the upper surface of the mattress support panel.

(17) In another variant, the mattress pad includes means for removably securing the lower surface of the mattress pad to either the upper surface of the mattress support panel or the top surface of the floor.

(18) In yet another variant, the mattress pad includes a washable cover. The washable cover is sized and shaped to fit over the mattress pad. Means are provided for removably securing the washable cover to the lower surface of the mattress pad. The washable cover has means for being removably secured to the upper surface of the mattress support panel or the floor.

(19) In yet a further variant, the mattress pad includes at least three portions. Each of the portions has a rigid bottom section and a padded top section. The portions are hingedly attached to each other. Means are provided for removably attaching outer edges of the mattress pad together. The mattress pad serves as an enclosure for the co-sleeper when folded for transport and storage.

(20) In still a further variant, the mattress pad includes a slat-receiving pocket and a stiffening slat. The slat receiving pocket extends across the bottom sections of the at least three portions and is sized and shaped to receive the stiffening slat for further supporting the mattress pad.

(21) In another variant of the invention, at least a portion of the surrounding wall is formed of mesh material.

(22) In still another variant, the surrounding wall includes a reclosable opening. The opening provides access to a space between the floor and the mattress support panel.

(23) In yet another variant, the co-sleeper includes height adjusting means for changing a height of the co-sleeper such that the upper surface of the mattress support panel is located at a level below an upper surface of a mattress of the parental bed.

(24) In yet a further variant, the height adjusting means comprises extensions that attach to lower edges of the enclosure.

(25) In still a further variant, the co-sleeper includes removable wheels. The wheels attach to either the lower edges of the enclosure or the extensions.

(26) In another variant, the co-sleeper includes at least one pair of alignment means through which the securing strap assembly is directed for maintaining the securing strap assembly in horizontal orientation and preventing lifting or bucking of the co-sleeper when secured to the parental bed. The co-sleeper also includes at least one pair of securing strap attachment means for fastening the securing strap assembly to the co-sleeper.

(27) In still another variant, the securing strap assembly includes a strap member that has a first end and a second end. A resistance plate member is provided that has at least two slots vertically aligned and centrally located at which the strap member is attached such that the first end and the second end are equidistant from the plate member. Attachment cooperation means are located at the first end and the second end of the strap member for reversible connection to one of the pairs of securing strap attachment means. Adjusting means are provided for adjusting a length of the strap member and tightening it after connecting the attachment cooperation means to one of the pairs of securing strap attachment means. The strap member is properly positioned when located under a mattress and above a surface on which the mattress rests on the parental bed and held in place by the resistance plate member located vertically at a side of the parental bed opposite placement of the co-sleeper and the strap member is tightened so the co-sleeper is held fast to the parental bed.

(28) In still a further variant of the invention, the front wall is comprised of flexible material and means for supporting the flexible material.

(29) In yet a further variant, the co-sleeper includes means for constraining a portion of the flexible material when the front wall is lowered from the first position at the top to one of the second positions below the top.

(30) In another variant, the means for constraining a portion of the flexible material includes a first strap portion. The first strap portion has a first end and a second end and is attached at the first end to an inner surface of the front wall at a level below the at least one second position. A receiving connector is provided. The receiving connector is attached to the first strap portion at the second end. A second strap portion is provided. The second strap portion has a first end and a second end and is attached at the first end to an outer surface of the front wall at a level below the at least one second position. An attaching connector is provided. The attaching connector has a slot. The slot is sized and shaped to fit slidably over the second strap portion. The second strap portion is looped through the slot of the attaching connector and removably attached to itself with a slidable adjusting buckle. When the front wall is in one of the second positions and the attaching connector is disposed in the receiving connector, the slidable adjusting buckle is moved to tighten the first and second strap portions so as to constrain the portion of the flexible material.

(31) In still another variant, the co-sleeper includes an inside pocket. The inside pocket has a reversibly closable top opening and is located on the inner surface of the front wall with the first end of the first strap portion attached to the front wall within the inside pocket. An outside pocket is provided. The outside pocket has a reversibly closable top opening and is located upon the outer surface of the front wall with the first end of the second strap portion attached to the front wall within the outside pocket. When the first and second strap portions with attached receiving and attaching connectors are not needed to constrain the portion of the flexible material, the strap portions are stored within the inside and outside pockets, respectively.

(32) In yet another variant, a portion of the front wall is formed of mesh material.

(33) In a further variant, the means for reversibly lowering the height of at least a portion of the front wall includes a first set of reversibly separable fasteners located adjacent a top edge of the front wall adjacent a first side edge of the front wall. A second set of reversibly separable fasteners is located adjacent a top edge of the front wall adjacent a second side edge of the front wall. When the front wall is lowered from the first, upper position to one of the second lower positions, the reversibly separable fasteners are opened to permit the front wall to be lowered while securing any excessive flexible material when the front wall is in the first upper position.

(34) In yet a further variant, at least one upper mattress control slit is provided. The upper mattress control slit penetrates the mattress support panel. At least one upper releasable attachment means is provided. The upper releasable attachment means is located on the lower surface of the mattress support panel adjacent the mattress control slit. At least one attachment strip is provided. The attachment strip is attached to the lower surface of the mattress pad, is sized and shaped to fit slidably through the mattress control slit and has means for attaching to the releasable attachment means. When the mattress pad is located on the mattress support panel, the attachment strip is located through the upper mattress control slit and attached to the upper releasable attachment means, the mattress pad will be removably secured to the mattress support panel.

(35) In still a further variant, at least one lower mattress control slit is provided. The lower mattress control slit penetrates the floor. At least one lower releasable attachment means is provided. The lower releasable attachment means is located on the bottom surface of the floor adjacent the lower mattress control slit. At least one attachment strip is provided. The attachment strip is attached to the lower surface of the mattress pad, is sized and shaped to fit slidably through the lower mattress control slit and has means for attaching to the lower releasable attachment means. When the mattress pad is located on the floor, the attachment strip is located through the lower mattress control slit and attached to the lower releasable attachment means, the mattress pad will be removably secured to the floor.

(36) In another variant of the invention, the portable combination bedside co-sleeper includes a rigid enclosure that has an open top, a floor, a front wall, a back wall, a first side wall, a second side wall and a mattress support panel. The floor has a top surface, a bottom surface and surrounding side edges and is attached to the front wall, back wall, first side wall and second side wall at the surrounding side edges. The mattress support panel has an upper surface, a lower surface, an outer perimeter and is removably attached to the front wall, back wall, first side wall and second side wall at the outer perimeter and is spaced upwardly from the floor. A mattress pad is provided. The mattress pad has an upper surface, a lower surface and is sized and shaped to fit slidably between the front wall, back wall, first side wall and second side wall.

A rigid frame is provided. The frame is formed at the top by front and rear upper parallel horizontal rails, first and second upper side horizontal rails, two upper front corner members and two upper rear corner members in cooperation therewith. The frame is formed adjacent the floor by front and rear lower parallel horizontal rails and first side and second side lower parallel horizontal rails in cooperation therewith, a pair of front vertical rails and a pair of rear vertical rails in further cooperation with the two upper front corner members and the two upper rear corner members and the four lower corner leg members. The rigid frame supports the floor, the front wall, the back wall, the first side wall and the second side wall. Each upper front corner member is constructed of two reversibly separable complementary sections. The first of the sections is fixedly attached to an end of the front upper horizontal rail and the second of the sections is fixedly attached to an upper end of one of the front vertical rails. The upper front corner members support the upper front horizontal rail in a first position.

Receiving means are fixedly attached to each front vertical rail for receiving the first section of an upper front corner member and reversibly maintaining the upper front horizontal rail in at least one lower second position, thereby lowering the front wall and maintaining structural rigidity of the co-sleeper when the upper front horizontal rail is in one of the second positions. A securing strap assembly is provided for securing the co-sleeper to a parental bed. When the upper front horizontal rail and the front wall are in the raised first position, the co-sleeper is usable as a bassinet; and when the upper front horizontal rail and the front wall are then lowered to one of the second positions, the co-sleeper is usable as a changing table. Further, when the securing strap assembly is properly positioned and the co-sleeper is secured to the parental bed it will serve as a co-sleeper.

(37) In still another variant, first and second padded covers are provided. Each of the padded covers is sized and shaped to fit over one of the two upper front corner members. Means are provided for attaching the first and second padded covers to the first and second side walls. When the upper front horizontal rail is in the second position and the first and second padded covers are installed over the upper front corner members, openings in the corner members will be covered and thus protected from entry by fingers of infants or small children.

(38) In yet another variant, the front and rear upper parallel horizontal rails and first and second upper side horizontal rails are padded.

(39) In a further variant, the floor includes a series of first reinforcing straps. The first reinforcing straps are located on the bottom surface of the floor. At least two of the first reinforcing straps are attached to the rigid frame.

(40) In still a further variant, the floor includes at least two fastening portions extending outwardly from the first reinforcing straps and attaching to the rigid frame. At least two securing portions are provided. The securing portions attach the fastening portions to lower edges of the front wall, the back wall, the first side wall and the second side wall.

(41) In yet a further variant, the floor includes means for removably securing the lower surface of the mattress pad to the top surface of the floor.

(42) In another variant of the invention, the mattress support panel is formed of mesh material.

(43) In still another variant, the mattress support panel includes a series of reinforcing panels. The reinforcing panels are attached to the upper surface of the mattress support panel. A series of second reinforcing straps is provided. The second reinforcing straps are attached to the lower surface of the mattress support panel.

(44) In a further variant, spacing of the mattress support panel upwardly from the floor is adjustable between a first, lower position to at least one second higher position. This permits the mattress pad to be maintained at at least two different heights relative to an upper mattress surface of the parental bed.

(45) In still a further variant, the mattress support panel is removably attached to the front wall, back wall, first side wall and second side wall at the outer perimeter using a first zipper.

(46) In yet a further variant, means are provided for securing an openable end of the first zipper.

(47) In another variant, the means for securing an openable end of the first zipper includes a first reversibly separable securing tab. The first securing tab is attached to a zipper pull of the first zipper. A zipper pull cover is provided. The zipper pull cover has a side edge, a top surface, a bottom surface and a first reversibly separable pad attached to the bottom surface. The zipper pull cover is attached at the side edge to an inner surface of either of the front wall, back wall, first side wall and second side wall adjacent the openable end of the first zipper. A second reversibly separable attachment pad is provided. The second attachment pad is attached to the upper surface of the mattress support panel adjacent the openable end of the first zipper. When the first zipper is in a closed position, the first reversibly separable pad of the zipper pull cover will attach to the first securing tab and the second reversibly separable attachment pad, thereby preventing easy opening of the first zipper.

(48) In still another variant, a flexible covering is provided for an upper portion of the first zipper to prevent injury to an infant or small child.

(49) In yet another variant, the mattress support panel includes a surrounding edge panel. The surrounding edge panel extends upwardly from the outer perimeter for a first predetermined distance and has an upper edge. A second zipper is provided. The second zipper removably attaches the surrounding edge panel either to the front wall, the back wall, the first side wall and the second side wall at the upper edge. When the second zipper attaches the upper edge to the front wall, the back wall, the first side wall and the second side wall the mattress support panel will be located on the first lower position. When the first zipper also attaches the outer perimeter to the front wall, the back wall, the first side wall and the second side wall the mattress support panel will be located on the second higher position.

(50) In a further variant, means are provided for securing an openable end of the second zipper.

(51) In still a further variant, the means for securing an openable end of the second zipper includes a second reversibly separable securing tab. The second securing tab attaches to a zipper pull of the second zipper. A zipper pull cover is provided. The zipper pull cover has a side edge, a top surface, a bottom surface and a first reversibly separable pad attached to the bottom surface. The zipper pull cover is attached at the side edge to an inner surface of either of the front wall, back wall, first side wall and second side wall adjacent the openable end of the second zipper. A third reversibly separable attachment pad is provided. The third attachment pad is attached adjacent the upper edge of the surrounding edge panel adjacent the openable end of the second zipper. When the second zipper is in a closed position, the first reversibly separable pad of the zipper pull cover will attach to the second securing tab and the third reversibly separable attachment pad, thereby preventing easy opening of the second zipper.

(52) In yet a further variant of the invention, a flexible covering is provided for an upper portion of the second zipper to prevent injury to an infant or small child.

(53) In another variant, the mattress support panel includes means for removably securing the lower surface of the mattress pad to the upper surface of the mattress support panel.

(54) In still another variant, the mattress pad includes means for removably securing the lower surface of the mattress pad to either the upper surface of the mattress support panel or the top surface of the floor.

(55) In yet another variant, the mattress pad includes a washable cover. The washable cover is sized and shaped to fit over the mattress pad. Means are provided for removably securing the washable cover to the lower surface of the mattress pad. The washable cover has means for being removably secured to the lower surface of the mattress pad and means for being removably secured to the upper surface of the mattress support panel.

(56) In a further variant, at least a portion of either of the back wall, the first side wall and the second side wall is formed of mesh material.

(57) In still a further variant, the back wall includes a reclosable opening. The reclosable opening provides access to a space between the floor and the mattress support panel.

(58) In yet a further variant, the co-sleeper includes height-adjusting means for changing a height of the co-sleeper such that the upper surface of the mattress support panel is located on at a level below an upper surface of a mattress of the parental bed.

(59) In yet another variant, the height adjusting means includes extensions that attach to the four lower corner leg members.

(60) In still another variant, removable wheels are provided. The wheels attach to either of four lower corner leg members and the extensions.

(61) In a further variant, the co-sleeper includes at least one pair of alignment means through which the securing strap assembly is directed for maintaining the securing strap assembly in horizontal orientation and preventing lifting or bucking of the co-sleeper when secured to the parental bed. The co-sleeper also includes at least one pair of securing strap attachment means for fastening the securing strap assembly to the co-sleeper.

(62) In still a further variant, the securing strap assembly includes a strap member that has a first end and a second end. A resistance plate member is provided that has at least two slots vertically aligned and centrally located on at which the strap member is attached such that the first end and the second end are equidistant from the plate member. Attachment cooperation means are provided that are located at the first end and the second end of the strap member for reversible connection to one of the pairs of securing strap attachment means. Adjusting means are provided for adjusting a length of the strap member and tightening it after connecting the attachment cooperation means to one of the pairs of security strap attachment means. The strap member is properly positioned when located under a mattress and above a surface on which the mattress rests on the parental bed. The strap member is held in place by the resistance plate member located vertically at a side of the parental bed opposite placement of the co-sleeper. The strap member is tightened so the co-sleeper is held fast to the parental bed.

(63) In another variant of the invention, the front wall is comprised of flexible material and means for supporting the flexible material.

(64) In still another variant, means are provided for constraining a portion of the flexible material when the front wall is lowered from the first position at the top to one of the second positions below the top.

(65) In yet another variant, the means for constraining a portion of the flexible material includes a first strap portion. The first strap portion has a first end and a second end and is attached at the first end to an inner surface of the front wall at a level below the at least one second position. A receiving connector is provided. The receiving connector is attached to the first strap portion at the second end. A second strap portion is provided. The second strap portion has a first end and a second end and is attached at the first end to an outer surface of the front wall at a level below the at least one second position. An attaching connector is provided. The attaching connector has a slot. The slot is sized and shaped to fit slidably over the second strap portion. The second strap portion is looped through the slot of the attaching connector and removably attached to itself with a slidable adjusting buckle. When the front wall is in one of the second positions and the attaching connector is located in the receiving connector, the slidable adjusting buckle may be moved to tighten the first and second strap portions so as to constrain the portion of the flexible material.

(66) In still another variant, an inside pocket is provided. The inside pocket has a reversibly closable top opening and is located on the inner surface of the front wall with the first end of the first strap portion attached to the front wall within the inside pocket. An outside pocket is provided. The outside pocket has a reversibly closable top opening and is located on the outer surface of the front wall with the first end of the second strap portion attached to the front wall within the outside pocket. When the first and second strap portions with attached receiving and attaching connectors are not needed to constrain the portion of the flexible material, the strap portions are stored within the inside and outside pockets, respectively.

(67) In yet another variant, a portion of the front wall is formed of mesh material.

(68) In a further variant, the rigid frame includes means for pivotally mounting the front and rear upper horizontal rails to the upper front corner members and upper rear corner members, respectively. Frame locking devices positioned at center points of the front and rear upper horizontal rail are pivotally mounted to the rails permitting the upper rails to pivot downwardly from the open top of the enclosure. Means are provided for pivotally mounting the first and second upper side horizontal rails to the upper front and rear corner members. Frame locking devices positioned at center points of the first and second upper side horizontal rails are pivotally mounted to the rails permitting each of the rails to pivot downwardly from the open top of the enclosure.

Means are provided for pivotally mounting the first side and second side lower horizontal rails to the lower corner leg members. Frame pivoting devices positioned at center points of the first side and second side lower horizontal rails are pivotally mounted to the rails permitting each of the rails to pivot upwardly. Means are provided for pivotally mounting the front and rear lower horizontal rails to the lower front and rear corner leg members, respectively. Frame pivoting devices positioned at center points of the front and rear lower horizontal rails are pivotally mounted to the rails permitting each of the rails to pivot upwardly. The frame may be quickly folded into a compact package for transport and storage by releasing the locking devices positioned on the front and rear upper horizontal rails and first and second upper side horizontal rails, depressing the upper horizontal rails downwardly while pulling upwardly on the frame pivoting devices on the lower horizontal rails, thereby causing the upper and horizontal rails to bend downwardly, the lower horizontal rails to bend upwardly and the vertical rails to move inwardly.

(69) In still a further variant, the mattress pad includes at least three portions. Each of the portions has a rigid bottom section and a padded top section. The portions are hingedly attached to each other. Means are provided for removably attaching outer edges of the mattress pad together. The mattress pad serves as an enclosure for the co-sleeper when folded for transport and storage.

(70) In yet a further variant, the mattress pad further comprises a slat-receiving pocket and a stiffening slat. The slat receiving pocket extends across the bottom sections of the at least three portions and is sized and shaped to receive the stiffening slat for further supporting the mattress pad.

(71) In another variant of the invention, the means for reversibly lowering the height of at least a portion of the front wall includes a first set of reversibly separable fasteners located adjacent a top edge of the front wall adjacent a first side edge of the front wall. A second set of reversibly separable fasteners is located adjacent the top edge of the front wall adjacent a second side edge of the front wall. When the front wall is lowered from the first, upper position to one of the second lower positions, the reversibly separable fasteners are opened to permit the front wall to be lowered while securing any excessive flexible material when the front wall is in the first upper position.

(72) In yet another variant, the first and second sections of the upper front corner members and the receiving means fixedly attached to each front vertical rail for receiving the first section of the upper front corner members and reversibly maintaining the upper front horizontal rail in at least one lower second position include a T-shaped protrusion extending from a point adjacent a lower end of the first section of the upper front corner members toward an upper end of the first section terminating in a stop. A securing extension located on the first section adjacent and below the T-shaped protrusion is provided. The securing extension is bendable away from the T-shaped protrusion and includes a retaining ledge. A first mating T-shaped slot is provided. The T-shaped slot extends from a point adjacent an upper end of the second section of the upper front corner member and terminates above a lower end of the upper front corner members.

A second mating T-shaped slot extends from a point adjacent an upper end of the receiving means toward a lower end of the receiving means and terminates above a lower end of the receiving means. At least two locating features are provided. The locating features are positioned on the second section and the receiving means adjacent and below the first and second T-shaped slots. The locating features are sized, shaped and located to be removably engaged by the retaining ledge of the securing extension so that the first section of the upper front corner member may be secured to either the second section or the receiving means.

(73) In still another variant, the rigid frame is formed of hollow tubing. The front, rear, first side and second side upper horizontal rails each have a first portion and a second portion. Each portion has an inboard end and an outboard end, and the frame locking devices positioned at center points of the upper horizontal rails include a connecting frame. The frame is pivotally mounted to the inboard ends of each of the first and second portions of the upper horizontal rails. The connecting frame includes a pair of locking holes. A pair of spring-loaded buttons is mounted within the upper horizontal rails. The buttons are sized, shaped and located to engage the locking holes in the connecting frame when the first and second portions of the upper horizontal rails are collinear. Means are provided for pushing both buttons inwardly so as to clear the locking holes in the connecting frame simultaneously, thereby permitting the upper horizontal rails to be pivoted downwardly.

(74) In a further variant, the rigid frame is formed of hollow tubing. The front, rear, first side and second side lower horizontal rails each have a first portion and a second portion. Each portion has an inboard end and an outboard end. The frame pivoting devices positioned at center points of the lower horizontal rails include a spring housing. The spring housing is pivotally mounted upon a pair of mounting pins to the inboard ends of each of the first and second portions of the lower horizontal rails. The spring housing includes first and second pairs of arcurate alignment slots and first and second pairs of positioning detents. First and second alignment pins are provided. The alignment pins are mounted parallel to the mounting pins and spaced outwardly from the inboard ends of the first and second portions of the lower horizontal rails. The alignment pins are sized, shaped and located to fit slidably within the arcurate alignment slots. Each of the pairs of positioning detents is spaced apart by a distance slightly less than a diameter of one of the lower horizontal rails. When the first and second portions of the lower horizontal rails are collinear, the rails will be within the spring housing and when the rails are pivoted with respect to one another to fold the co-sleeper, the detents will be urged against the rails by a spring resistance of the housing, causing the housing to spread apart, such resistance serving to maintain collinear alignment of the lower horizontal rails when the co-sleeper is erected.

(75) In a further variant, the first section of the front upper corner member is a male section and the second section is a female section. The second section has an opening sufficiently small so as to prevent entry of fingers of small children or infants.

(76) In a final variant of the invention, the receiving means is a female section for association with a male section. The receiving means has an opening sufficiently small so as to prevent the entry of fingers of small children or infants.

DESCRIPTION OF THE FIGURES

FIG. 1 is a perspective view of the preferred embodiment of the invention in a first position at the top;

FIG. 6 is a perspective view of the enclosure illustrating the floor and top;

FIG. 8 is a cross-sectional detail of FIG. 7 taken along the line 8—8;

FIG. 10 is a cross-sectional detail of FIG. 9 taken along the line 10—10;

FIG. 12B is a perspective detail view of the means for securing an openable end of the second zipper, the second reversibly separable securing tab, the zipper pull of the second zipper, the zipper pull cover and the third reversibly separable attachment pad;

Figure 1A:
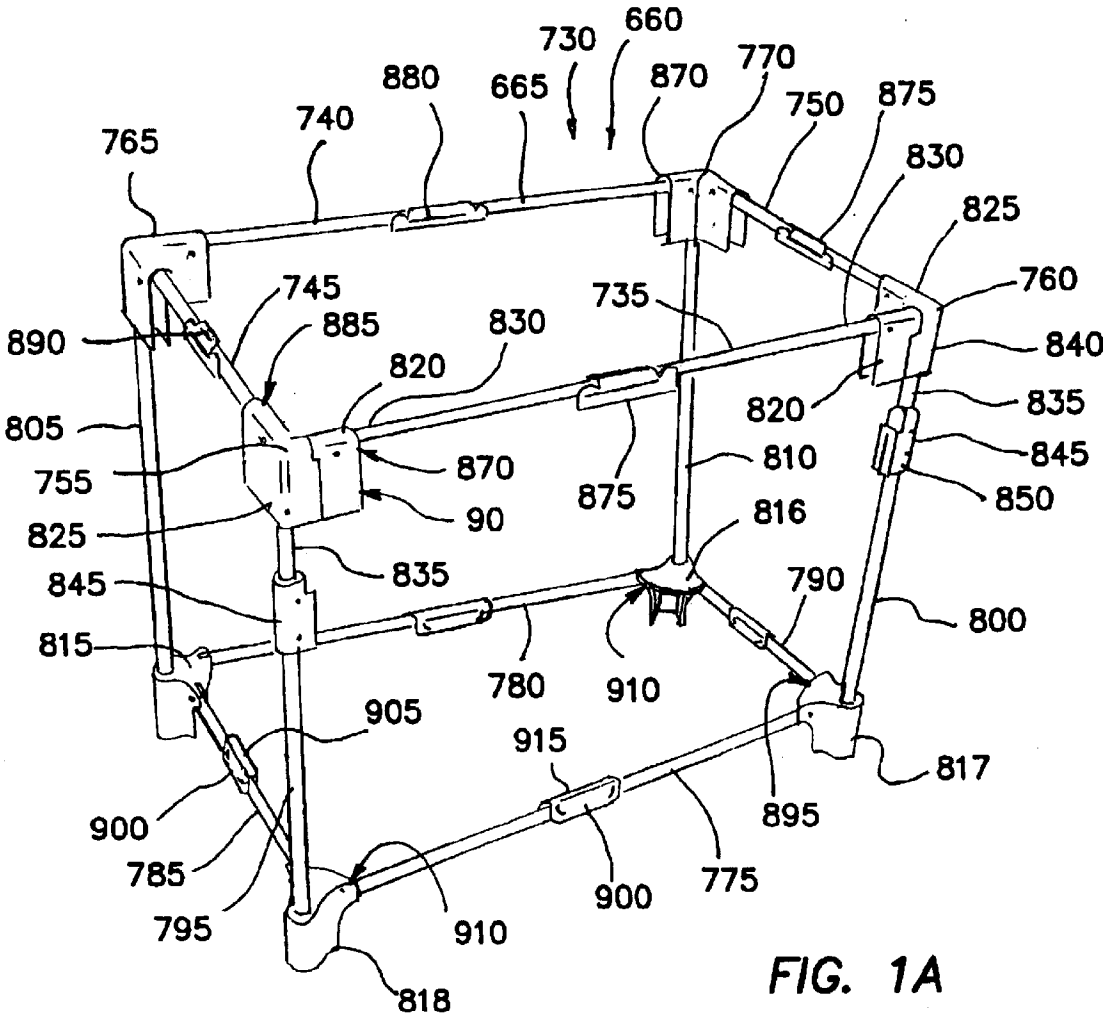
FIG. 1A is a perspective view of the rigid frame of the preferred embodiment of the invention illustrating the two reversibly separable complimentary sections of the two upper front corner members, the receiving means, the frame locking devices and the frame pivoting devices.

DETAILED DESCRIPTION OF THE PREFERRED EMBODIMENT (1) As illustrated in FIGS. 1, 2, 4, 6, 11, 15, 16 and 16A, the present invention is a portable combination bedside co-sleeper 10 convertibly adapted for use as a bassinet, changing table and playpen. The co-sleeper 10, includes an enclosure 15 that has an open top 20, a floor 25, a mattress support panel 30, a front wall 35, and at least one surrounding wall 40 connected to the front wall 35. The floor 25 has a top surface 45, a bottom surface 50 and surrounding side edges 55 and is attached to the front wall 35 and the surrounding wall 40 at the surrounding side edges 55. The mattress support panel 30 has an upper surface 60, a lower surface 65, an outer perimeter 70 and is removably attached to the front wall 35 and the surrounding wall 40 at the outer perimeter 70 and is spaced upwardly from the floor 25. A mattress pad 75 is provided. The mattress pad 75 has an upper surface 80, a lower surface 85 and is sized and shaped to fit slidably between the front wall 35 and the surrounding wall 40.

Means 90 are provided for reversibly lowering a height 95 of at least a portion 100 of the front wall 35, from a first position 105 at the top 20 to at least one second position 110 below the top 20. A securing strap assembly 115 is provided for securing the co-sleeper 10 to a parental bed 120. When the front wall 35 is raised to the first position 105, the co-sleeper 10 is usable as a bassinet; and when the front wall 35 is then lowered to one of its second positions 110, the co-sleeper 10 is usable as a changing table. When the securing strap assembly 115 is properly positioned and the co-sleeper 10 is secured to the parental bed 120 it will serve as a co-sleeper 10.

Figure 18:
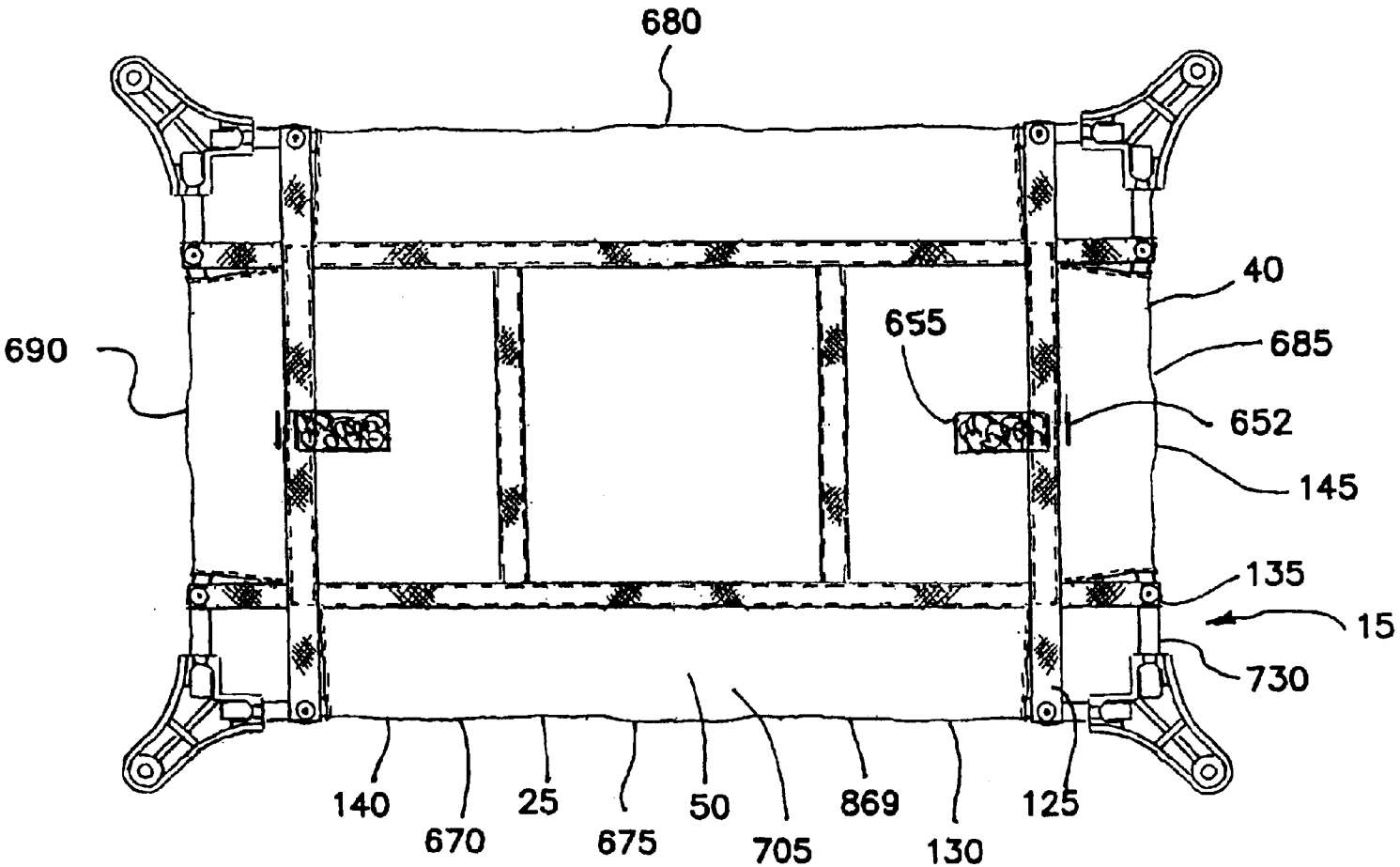
FIG. 18 is a perspective view of the bottom surface of the floor and the enclosure.

(2) In a variant of the invention, as shown in FIG. 18, the floor 25 further includes a series of first reinforcing straps 125. The first reinforcing straps 125 are located upon the bottom surface 50 of the floor 25. At least two of the first reinforcing straps 125 are attached to the enclosure 15.

Figure 3:
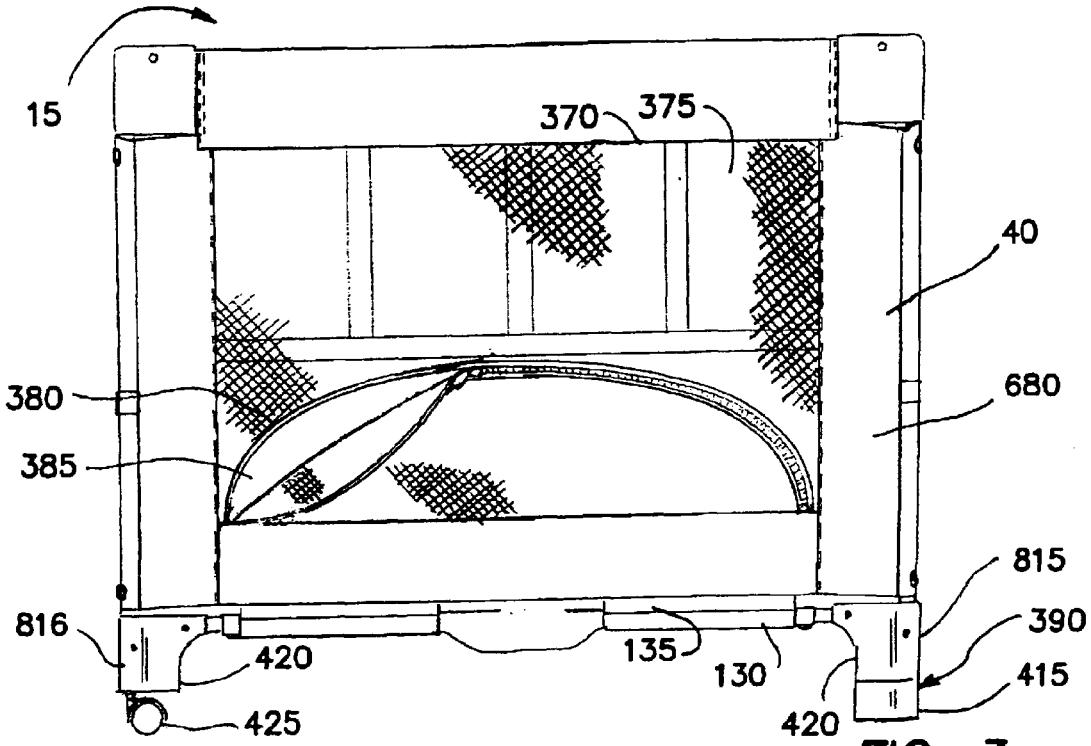
FIG. 3 is a cross-sectional side view of the enclosure illustrating the portion of the surrounding wall formed of mesh material and the reclosable opening.

(3) In another variant, as shown in FIGS. 3 and 18, the floor 25 further includes at least two fastening portions 130 extending outwardly from the first reinforcing straps 125 and attaching to the enclosure 15 and at least two securing portions 135. The securing portions 135 attach the fastening portions 130 to a lower edge 140 of the front wall 35 and to a lower edge 145 of the surrounding wall 40.

(4) In still another variant, as shown in FIG. 6, the floor 25 further includes means 150 for removably securing the lower surface 85 of the mattress pad 75 to the top surface 45 of the floor 25.

Figure 16:
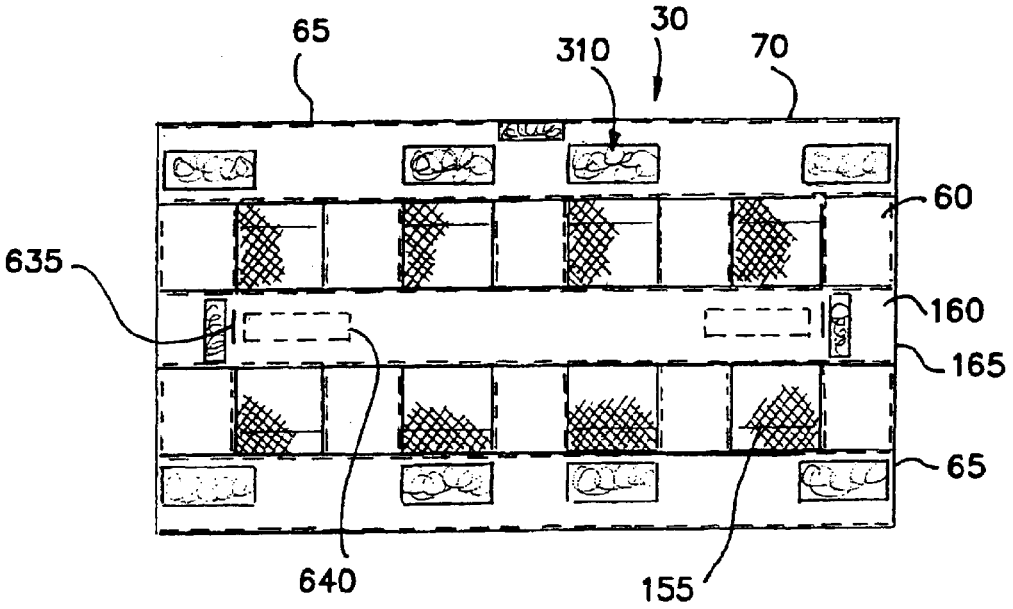
FIG. 16 is a perspective view of the upper surface of the mattress support panel.

(5) In yet another variant of the invention, as shown in FIG. 16, the mattress support panel 30 is formed of mesh material 155.

Figure 16A:
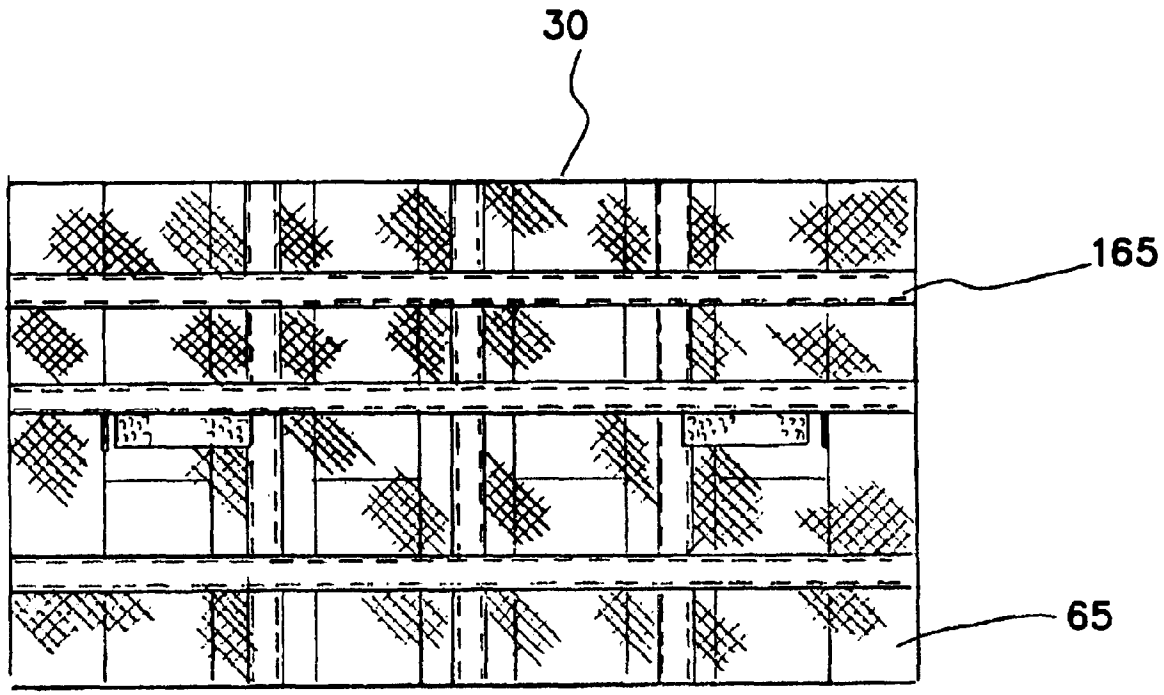
FIG. 16A is a perspective view of the lower surface of the mattress support panel.

(6) In still another variant, as shown in FIGS. 16 and 16A, the mattress support panel 30 further includes a series of reinforcing panels 160. The reinforcing panels 160 are attached to the upper surface 60 of the mattress support panel 30. A series of second reinforcing straps 165 is provided. The second reinforcing straps 165 are attached to the lower surface 65 of the mattress support panel 30.

Figure 7:
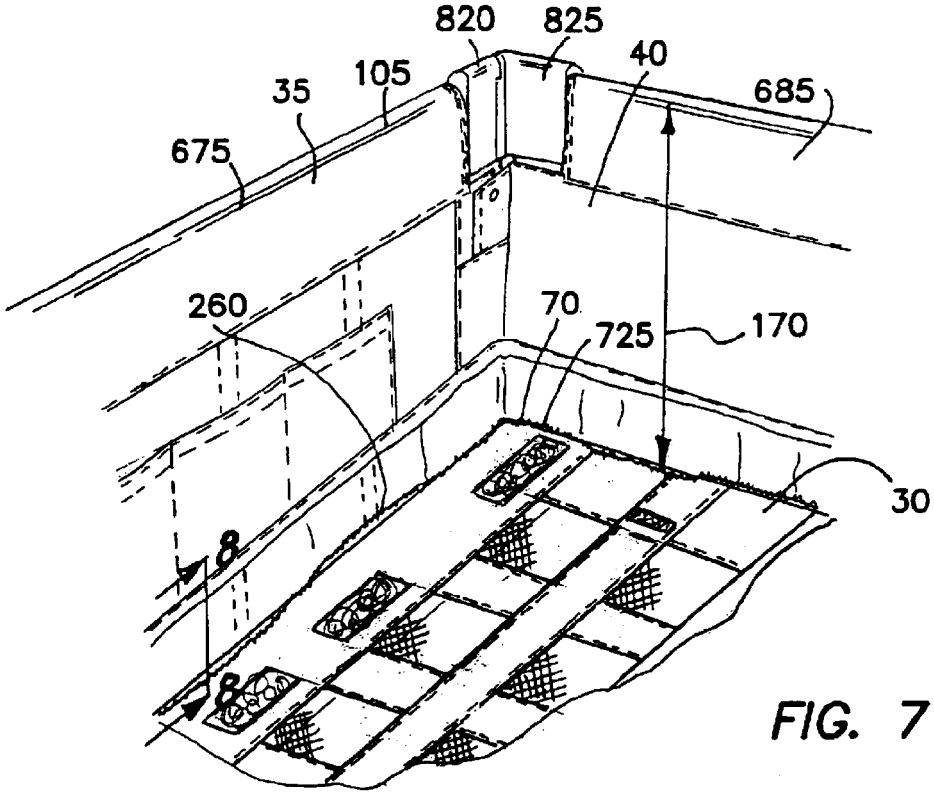
FIG. 7 is a perspective view of the enclosure illustrating the mattress support panel at the first lower position.
Figure 9:
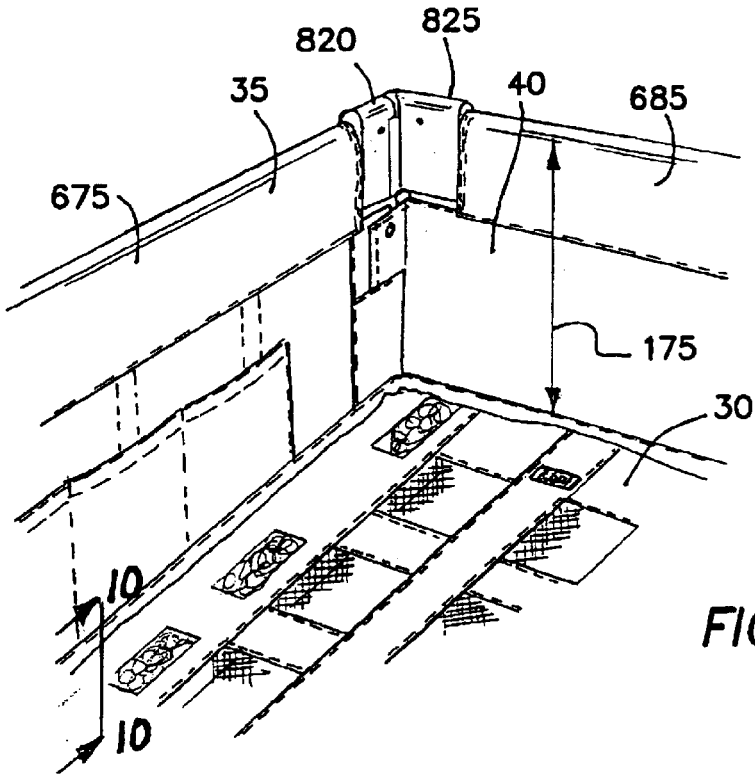
FIG. 9 is a perspective view of the enclosure illustrating the mattress support panel at the at least one second higher position.

(7) In another variant, as shown in FIGS. 7 and 9, spacing of the mattress support panel 30 upwardly from the floor 25 is adjustable between a first, lower position 170 to at least one second higher position 175, thereby permitting the mattress pad 75 to be maintained at at least two different heights relative to an upper mattress surface 177 of the parental bed 120.

Figure 12:
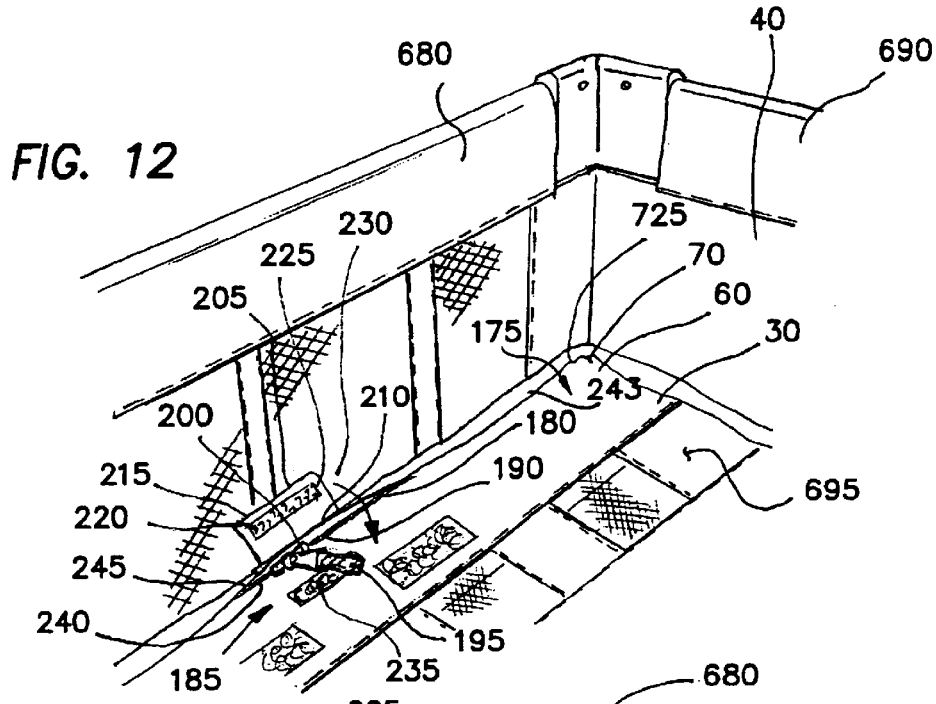
FIG. 12 is a perspective detail view of the mattress support panel removably attached to the enclosure and the means for securing an openable end of the first zipper.

(8) In still another variant, as shown in FIG. 12, the mattress support panel 30 is removably attached to the front wall 35 and the surrounding wall 40 at the outer perimeter 70 using a first zipper 180.

Figure 12A:
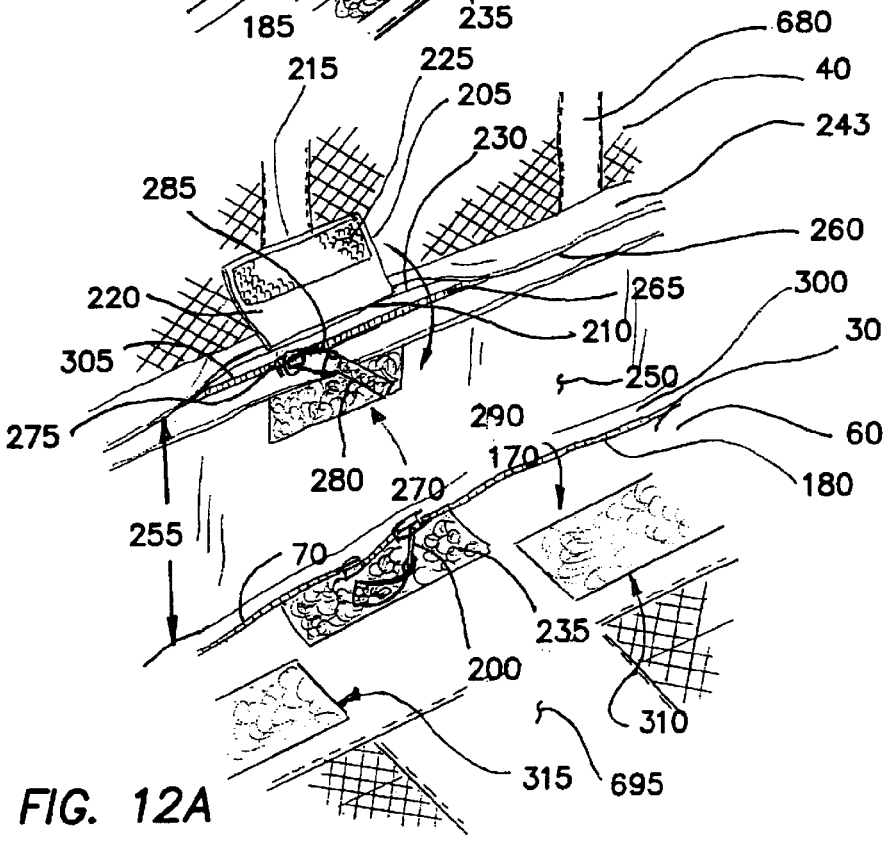
FIG. 12A is a perspective detail view of the means for securing an openable end of the first zipper, the first reversibly separable securing tab, the zipper pull cover of the first zipper, the second reversibly separable attachment pad, the surrounding edge panel, the flexible covering for an upper portion of the first zipper, the openable end of the second zipper, the second reversibly separable securing tab, the zipper pull cover of the second zipper and the third reversibly separable attachment pad.

(9) In yet another variant, as shown in FIGS. 12 and 12A, means 185 are provided for securing an openable end 190 of the first zipper 180.

(10) In yet a further variant of the invention, as shown in FIGS. 12 and 12A, the means 185 for securing an openable end 190 of the first zipper 180 includes a first reversibly separable securing tab 195. The first securing tab 195 attaches to a zipper pull 200 of the first zipper 180. A zipper pull cover 205 is provided. The zipper pull cover 205 has a side edge 210, a top surface 215, a bottom surface 220 and a first reversibly separable pad 225 attached to the bottom surface 220. The zipper pull cover 205 is attached at the side edge 210 to an inner surface 230 of either the front wall 35 or the surrounding wall 40 adjacent the openable end 190 of the first zipper 180. A second reversibly separable attachment pad 235 is attached to the upper surface 60 of the mattress support panel 30 adjacent the openable end 190 of the first zipper 180. When the first zipper 180 is in a closed position 240, the first reversibly separable pad 225 of the zipper pull cover 205 will attach to the first securing tab 195 and the second reversibly separable attachment pad 235, thereby preventing easy opening of the first zipper 180.

(11) In still a further variant, as shown in FIG. 12A, a flexible covering 243 for an upper portion 245 of the first zipper 180 is provided to prevent injury to an infant or small child (not shown).

(12) In another variant, as shown in FIGS. 12A and 12B, the mattress support panel 30 includes a surrounding edge panel 250. The surrounding edge panel 250 extends upwardly from the outer perimeter 70 for a first predetermined distance 255 and has an upper edge 260. A second zipper 265 is provided. The second zipper 265 removably attaches the surrounding edge panel 250 to the front wall 35 and the surrounding wall 40 at the upper edge 260. When the second zipper 265 attaches the upper edge 260 to the front wall 35 and the surrounding wall 40 the mattress support panel 30 will be located at the first lower position 170. When the first zipper 180 also attaches the outer perimeter 70 to the front wall 35 and the surrounding wall 40 the mattress support panel 30 will be located at one of the second higher positions 175.

(13) In still another variant, as shown in FIG. 12A, means 270 are provided for securing an openable end 275 of the second zipper 265.

(14) In yet another variant, as shown in FIGS. 8, 10, 12A and 12B, the means 270 for securing an openable end 275 of the second zipper 265 includes a second reversibly separable securing tab 280. The second securing tab 280 attaches to a zipper pull 285 of the second zipper 265. The zipper pull cover 205 is attached at the side edge 210 to an inner surface 230 of either the front wall 35 or the surrounding wall 40 adjacent the openable ends 190, 275 of the first zipper 180 and the second zipper 265. A third reversibly separable attachment pad 290 attaches adjacent the upper edge 260 of the surrounding edge panel 250 adjacent the openable end 275 of the second zipper 265. When the second zipper 265 is in a closed position 295, the first reversibly separable pad 225 of the zipper pull cover 205 will attach to the second securing tab 280 and the third reversibly separable attachment pad 290, thereby preventing easy opening of the second zipper 265.

(15) In a further variant, as shown in FIG. 12A, the flexible covering 243 is provided for an upper portion 305 of the second zipper 265 to prevent injury to an infant or small child (not shown).

(16) In still a further variant of the invention, as shown in FIG. 16, the mattress support panel 30 includes means 310 for removably securing the lower surface 85 of the mattress pad 75 to the upper surface 60 of the mattress support panel 30.

Figure 11:
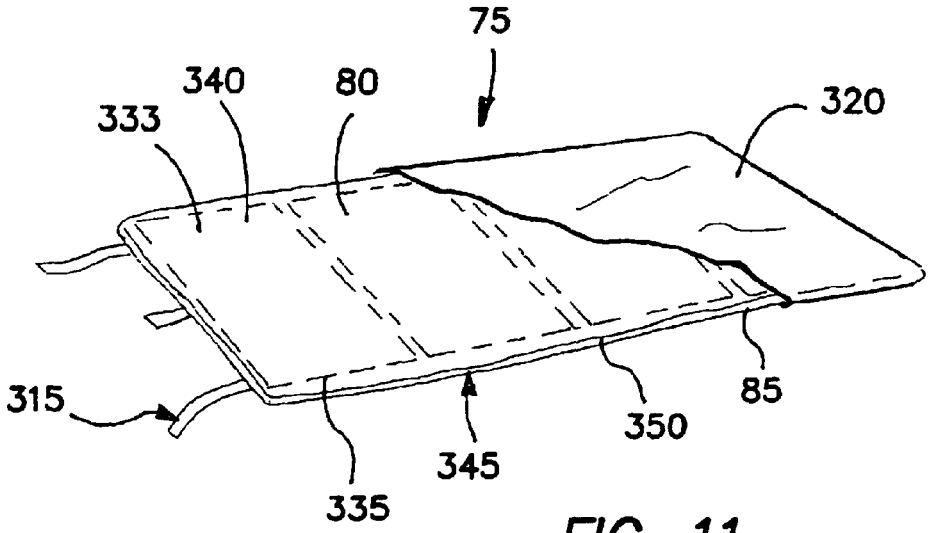
FIG. 11 is a perspective view of the mattress pad with washable cover.
Figure 11A:
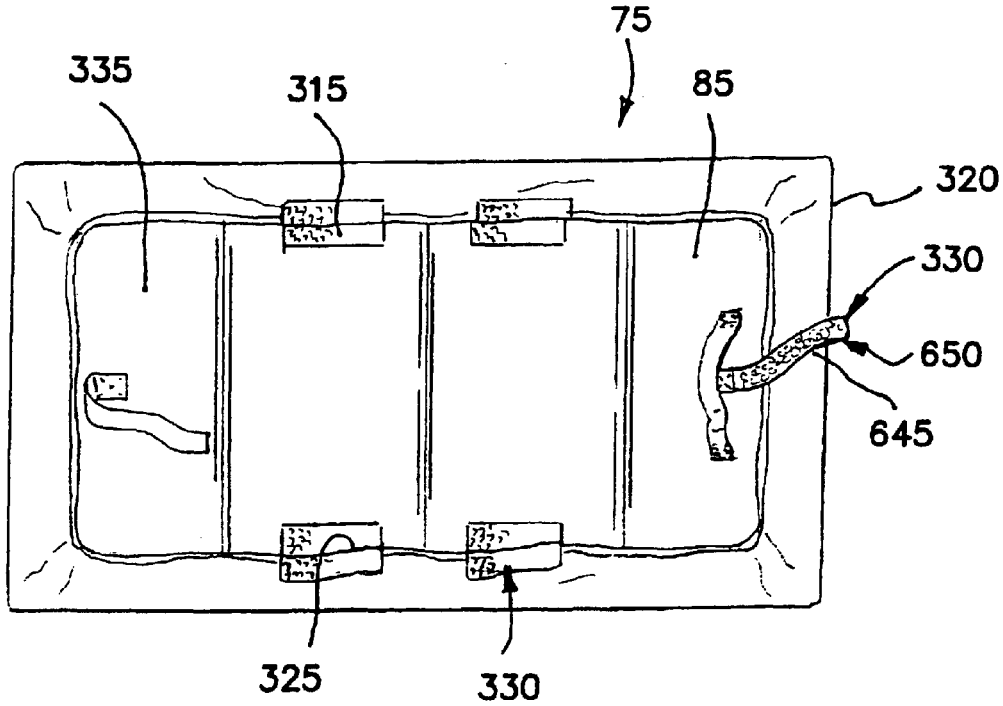
FIG. 11A is a perspective view of the means for removably securing the washable cover to the mattress pad and the means for removably securing the mattress pad to the mattress support panel.

(17) In another variant, as shown in FIG. 11A, the mattress pad 75 includes means 315 for removably securing the lower surface 85 of the mattress pad 75 to either the upper surface 60 of the mattress support panel 30 or the top surface 45 of the floor 25.

(18) In yet another variant, as shown in FIGS. 11 and 11A, the mattress pad 75 includes a washable cover 320. The washable cover 320 is sized and shaped to fit over the mattress pad 75. Means 325 are provided for removably securing the washable cover 320 to the lower surface 85 of the mattress pad 75. The washable cover 320 has means 330 for being removably secured to the upper surface 60 of the mattress support panel 30 or the floor 25.

Figure 24:
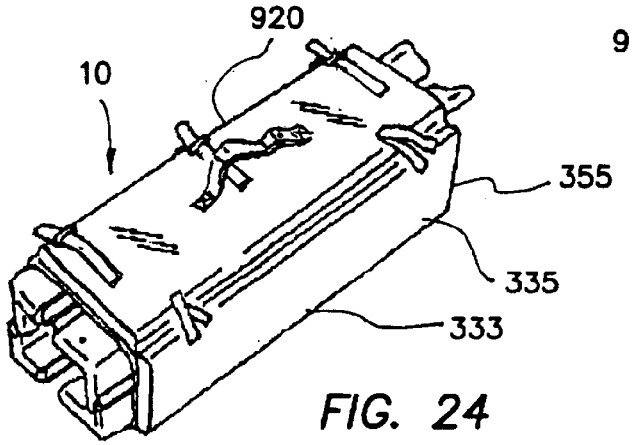
FIG. 24 is a perspective view of the FIG. 1 embodiment secured within the segmented rigid floor member as a compact package for transportation and storage.

(19) In yet a further variant, as shown in FIGS. 11 and 24, the mattress pad 75 includes at least three portions 333. Each of the portions 333 has a rigid bottom section 335 and a padded top section 340. The portions 333 are hingedly attached to each other. Means 345 are provided for removably attaching outer edges 350 of the mattress pad 75 together. The mattress pad 75 serves as an enclosure 355 for the co-sleeper 10 when folded for transport and storage.

Figure 17:
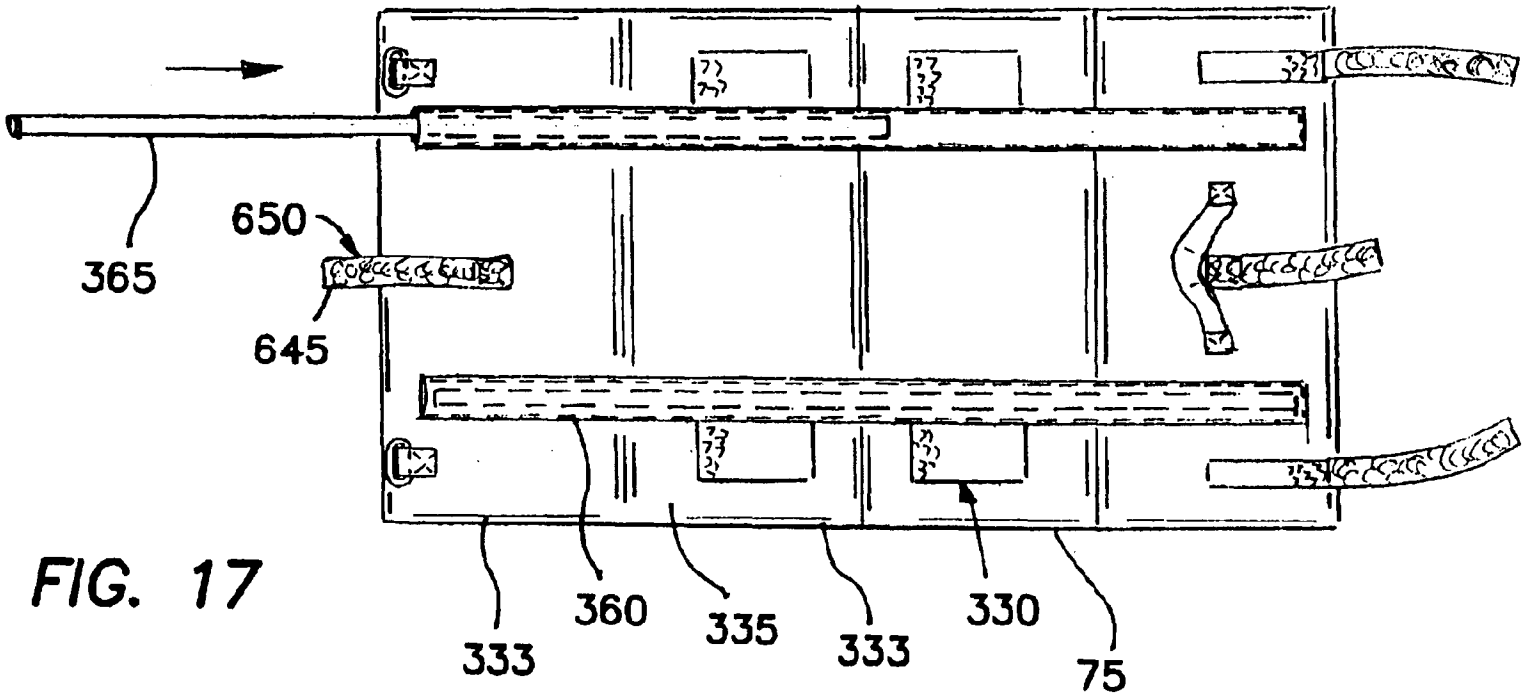
FIG. 17 is a perspective view of the mattress pad illustrating the slat-receiving pocket and the stiffening slat.

(20) In still a further variant, as shown in FIG. 17, the mattress pad 75 includes a slat-receiving pocket 360 and a stiffening slat 365. The slat receiving pocket 360 extends across the bottom sections 335 of the at least three portions 333 and is sized and shaped to receive the stiffening slat 365 for further supporting the mattress pad 75.

(21) In another variant of the invention, as shown in FIG. 3, at least a portion 370 of the surrounding wall 40 is formed of mesh material 375.

(22) In still another variant, as shown in FIG. 3, the surrounding wall 40 includes a reclosable opening 380. The opening 380 provides access to a space 385 between the floor 25 and the mattress support panel 30.

Figure 2:
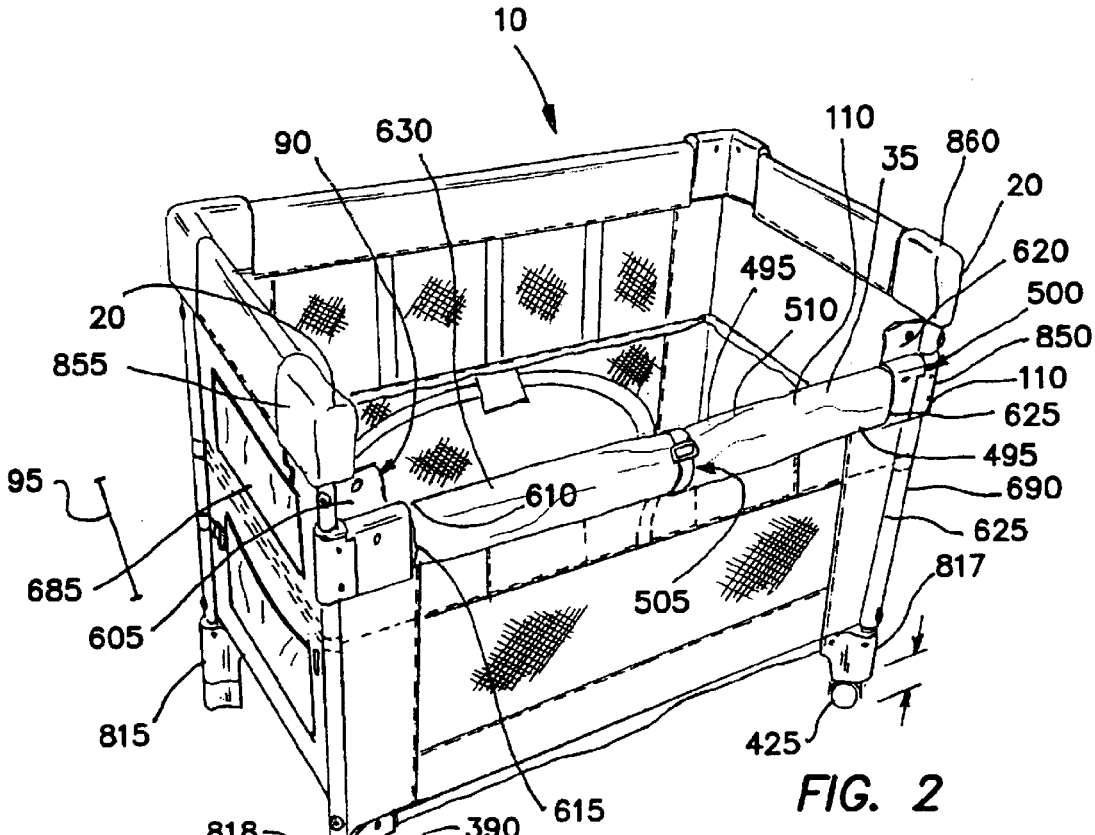
FIG. 2 is a perspective view of the preferred embodiment of the invention in the second position below the top illustrating the height adjustment means, the removable wheels and the means for constraining a portion of the flexible material.
Figure 19:
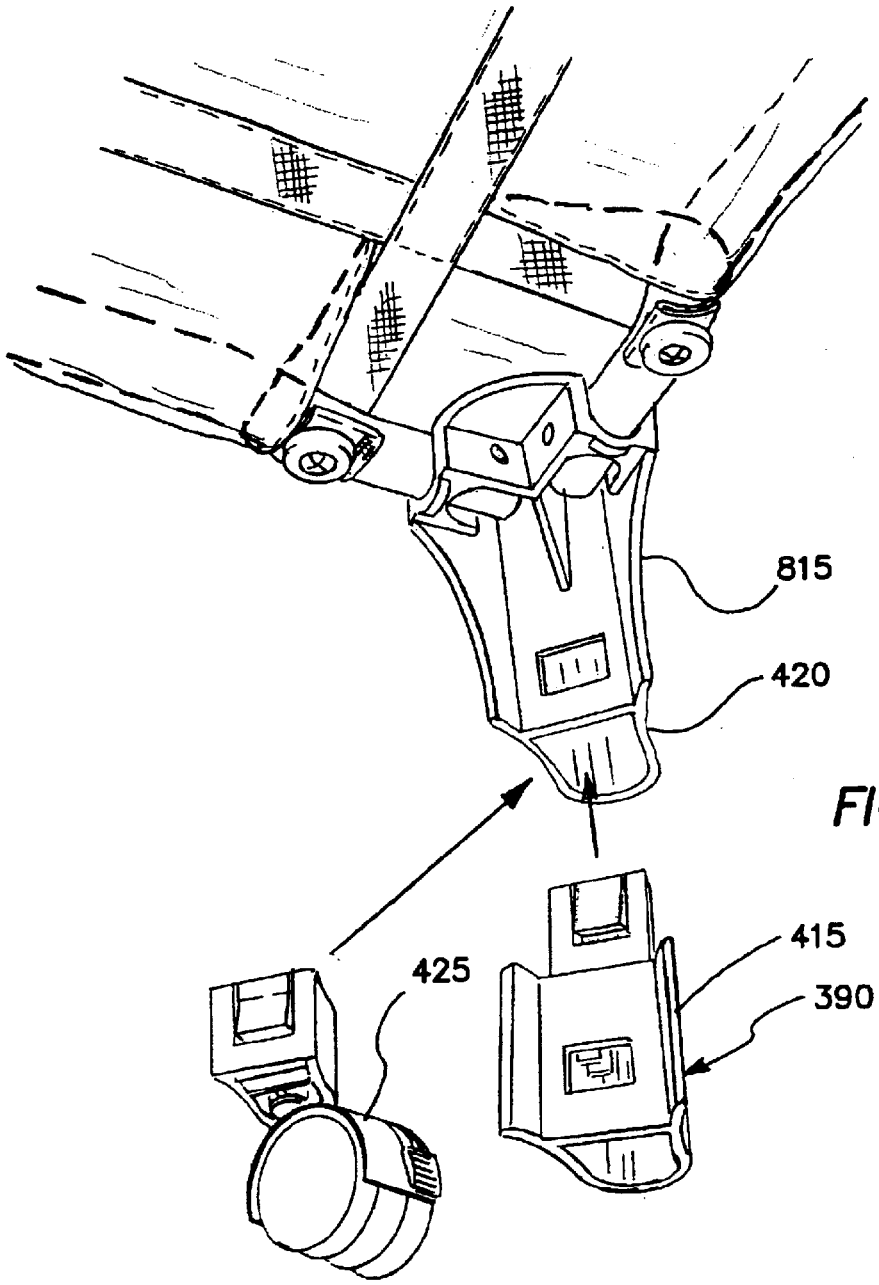
FIG. 19 is a perspective view of the height adjusting means and removable wheels attached to the lower edges of the enclosure.

(23) In yet another variant, as shown in FIGS. 2 and 19, the co-sleeper 10 includes height adjusting means 390 for changing a height 395 of the co-sleeper 10 such that the upper surface 60 of the mattress support panel 30 is located at a level 400 below an upper surface 405 of a mattress 410 of the parental bed 120.

(24) In yet a further variant, a shown in FIGS. 2, 3 and 19, the height adjusting means 390 comprises extensions 415 that attach to lower edges 420 of the enclosure 15.

(25) In still a further variant, as shown in FIGS. 2, 3 and 19, the co-sleeper 10 includes removable wheels 425. The wheels 425 attach to either the lower edges 420 of the enclosure 15 or the extensions 415.

Figure 4:
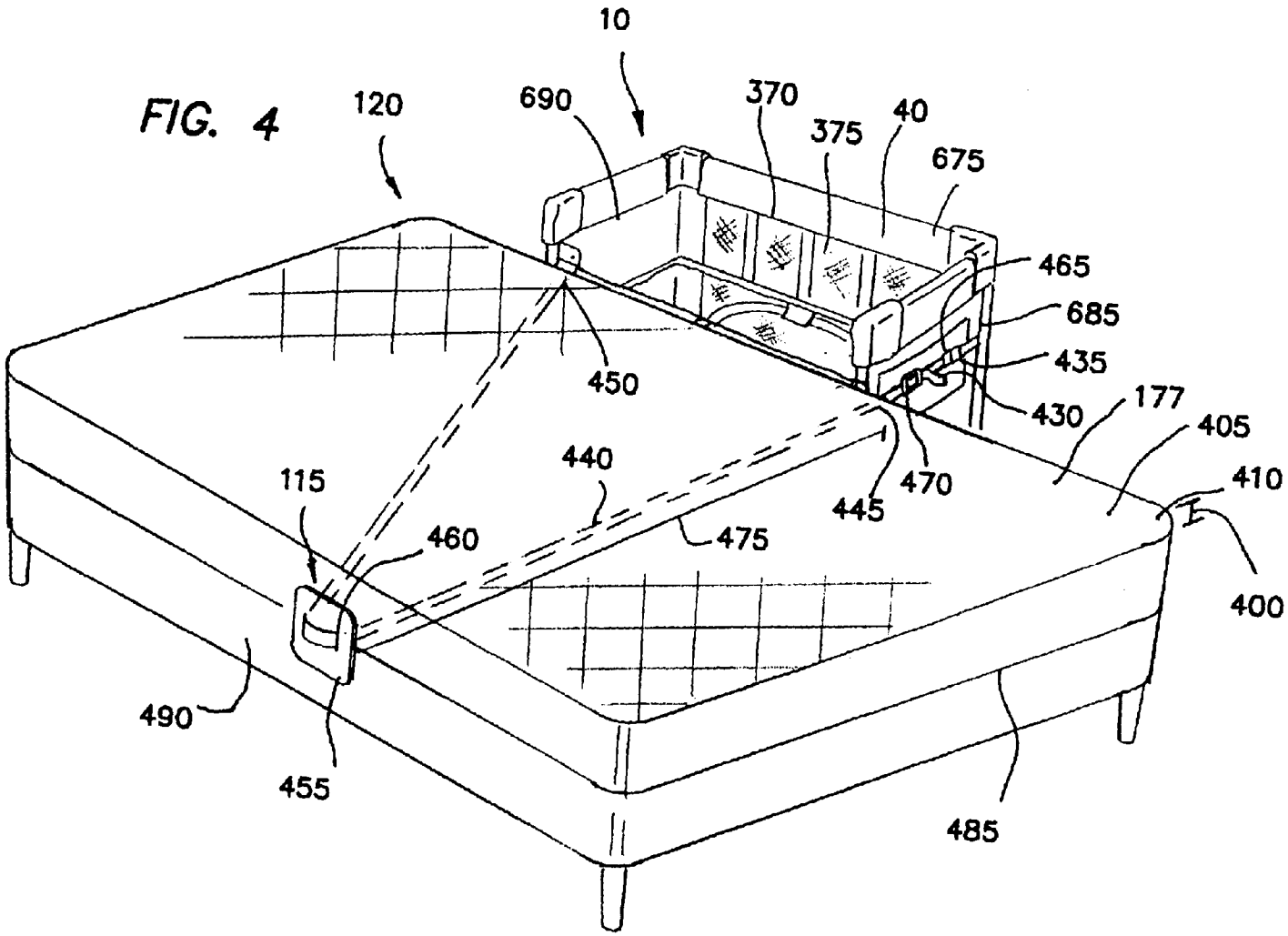
FIG. 4 is a perspective view of the co-sleeper attached to the parents' bed by means of the safety strap assembly.

(26) In another variant, as shown in FIG. 4, the co-sleeper 10 includes at least one pair of alignment means 430 through which the securing strap assembly 115 is directed for maintaining the securing strap assembly 115 in horizontal orientation and preventing lifting or bucking of the co-sleeper 10 when secured to the parental bed 120. The co-sleeper 10 also includes at least one pair of securing strap attachment means 435 for fastening the securing strap assembly 115 to the co-sleeper 10.

(27) In still another variant, as shown in FIG. 4, the securing strap assembly 115 includes a strap member 440 that has a first end 445 and a second end 450. A resistance plate member 455 is provided that has at least two slots 460 vertically aligned and centrally located at which the strap member 440 is attached such that the first end 445 and the second end 450 are equidistant from the plate member 455. Attachment cooperation means 465 are located at the first end 445 and the second end 450 of the strap member 440 for reversible connection to one of the pairs of securing strap attachment means 435. Adjusting means 470 are provided for adjusting a length 475 of the strap member 440 and tightening it after connecting the attachment cooperation means 465 to one of the pairs of securing strap attachment means 435. The strap member 440 is properly positioned when located under a mattress 410 and above a surface 485 on which the mattress 410 rests on the parental bed 120 and held in place by the resistance plate member 455 located vertically at a side 490 of the parental bed 120 opposite placement of the co-sleeper 10 and the strap member 440 is tightened so the co-sleeper 10 is held fast to the parental bed 120.

(28) In still a further variant of the invention, as shown in FIG. 2, the front wall 35 is comprised of flexible material 495 and means 500 for supporting the flexible material 495.

(29) In yet a further variant, as shown in FIGS. 1 and 2, the co-sleeper 10 includes means 505 for constraining a portion 510 of the flexible material 495 when the front wall 35 is lowered from the first position 105 at the top 20 to one of the second positions 110 below the top 20.

Figure 2A:
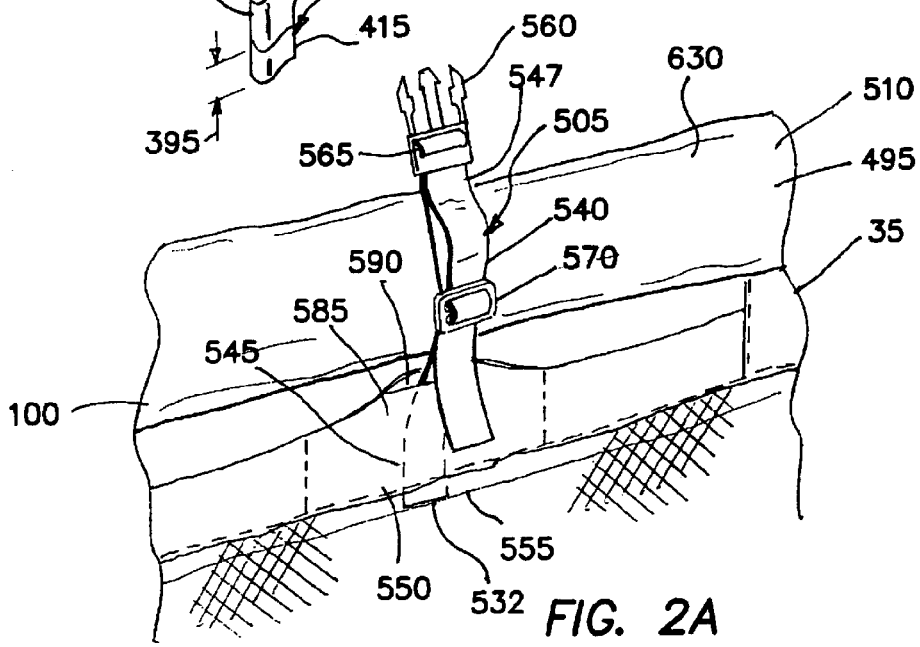
FIG. 2A is a partial cutaway perspective of the FIG. 1 embodiment illustrating the second strap portion attached to the front wall.

(30) In another variant, as shown in FIGS. 2A and 6, the means 505 for constraining a portion 510 of the flexible material 495 includes a first strap portion 515. The first strap portion 515 has a first end 520 and a second end 525 and is attached at the first end 520 to an inner surface 530 of the front wall 35 at a level 532 below the at least one second position 110. A receiving connector 535 is provided. The receiving connector 535 is attached to the first strap portion 515 at the second end 525. A second strap portion 540 is provided. The second strap portion 540 has a first end 545 and a second end 547 and is attached at the first end 545 to an outer surface 550 of the front wall 35 at a level 555 below the at least one second position 110. An attaching connector 560 is provided. The attaching connector 560 has a slot 565. The slot 565 is sized and shaped to fit slidably over the second strap portion 540. The second strap portion 540 is looped through the slot 565 of the attaching connector 560 and removably attached to itself 540 with a slidable adjusting buckle 570. When the front wall 35 is in one of the second positions 110 and the attaching connector 560 is located in the receiving connector 535, the slidable adjusting buckle 570 is moved to tighten the first 515 and second 540 strap portions so as to constrain the portion 510 of the flexible material 495.

(31) In still another variant, as shown in FIGS. 2A and 6, the co-sleeper 10 includes an inside pocket 575. The inside pocket 575 has a reversibly closable top opening 580 and is located on the inner surface 530 of the front wall 35 with the first end 520 of the first strap portion 515 attached to the front wall 35 within the inside pocket 575. An outside pocket 585 is provided. The outside pocket 585 has a reversibly closable top opening 590 and is located upon the outer surface 550 of the front wall 35 with the first end 545 of the second strap portion 540 attached to the front wall 35 within the outside pocket 585. When the first 515 and second 540 strap portions with attached receiving 535 and attaching 560 connectors are not needed to constrain the portion 510 of the flexible material 495, the strap portions 515, 540 are stored within the inside 575 and outside 585 pockets, respectively.

(32) In yet another variant, as shown in FIG. 1, a portion 595 of the front wall 35 is formed of mesh material 600.

(33) In a further variant, as shown in FIGS. 1, 2, 20 and 21, the means 90 for reversibly lowering the height 95 of at least a portion 100 of the front wall 35 includes a first set of reversibly separable fasteners 605 located adjacent a top edge 610 of the front wall 35 adjacent a first side edge 615 of the front wall 35. A second set of reversibly separable fasteners 620 is located adjacent the top edge 610 of the front wall 35 adjacent a second side edge 625 of the front wall 35. When the front wall 35 is lowered from the first, upper position 105 to one of the second lower positions 110, the reversibly separable fasteners 605, 620 are opened to permit the front wall 35 to be lowered while securing any excessive flexible material 630 when the front wall 35 is in the first upper position 105.

(34) In yet a further variant, as shown in FIGS. 11A and 16, at least one upper mattress control slit 635 is provided. The upper mattress control slit 635 penetrates the mattress support panel 30. At least one upper releasable attachment means 640 is provided. The upper releasable attachment means 640 is located on the lower surface 65 of the mattress support panel 30 adjacent the mattress control slit 635. At least one attachment strip 645 is provided. The attachment strip 645 is attached to the lower surface 85 of the mattress pad 75, is sized and shaped to fit slidably through the mattress control slit 635 and has means 650 for attaching to the releasable attachment means 640. When the mattress pad 75 is located on the mattress support panel 30, the attachment strip 645 is located through the upper mattress control slit 635 and attached to the upper releasable attachment means 640, the mattress pad 75 will be removably secured to the mattress support panel 30.

Figure 15:
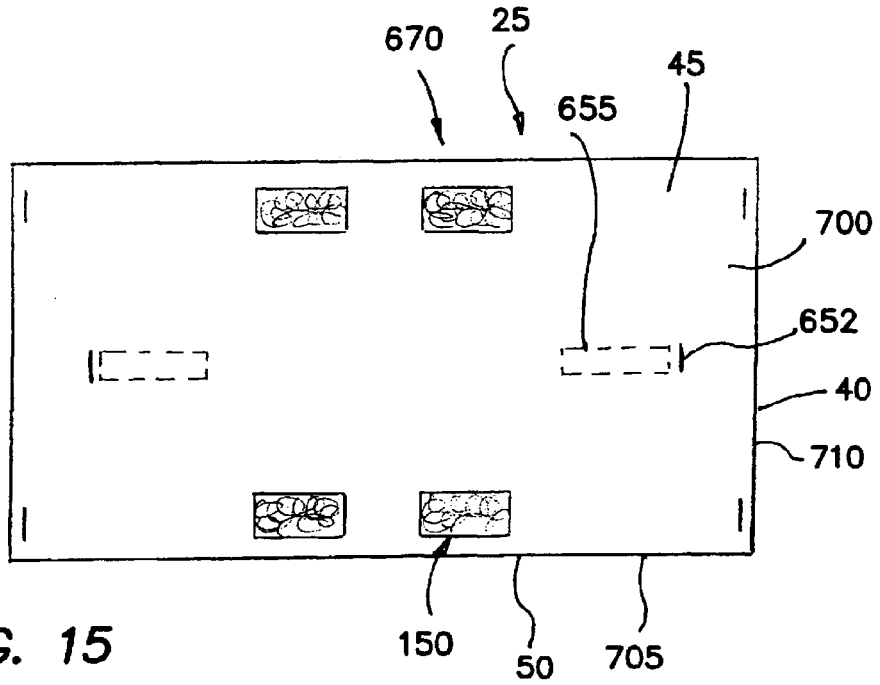
FIG. 15 is a perspective view of the floor illustrating the lower mattress control slit, the lower releasable attachment means and the attachment strip.

(35) In still a further variant, as shown in FIGS. 11A and 15, at least one lower mattress control slit 652 is provided. The lower mattress control slit 652 penetrates the floor 25. At least one lower releasable attachment means 655 is provided. The lower releasable attachment means 655 is located on the bottom surface 50 of the floor 25 adjacent the lower mattress control slit 652. At least one attachment strip 645 is provided. The attachment strip 645 is attached to the lower surface 85 of the mattress pad 75, is sized and shaped to fit slidably through the lower mattress control slit 652 and has means for attaching to the lower releasable attachment means 655. When the mattress pad 75 is located on the floor 25, the attachment strip 645 is located through the lower mattress control slit 652 and attached to the lower releasable attachment means 655, the mattress pad 75 will be removably secured to the floor 25.

(36) In another variant of the invention, as shown in FIGS. 1, 1A, 4, 11, 15, 16, 20 and 21, the portable combination bedside co-sleeper 10 includes a rigid enclosure 660 that has an open top 665, a floor 670, a front wall 675, a back wall 680, a first side wall 685, a second side wall 690 and a mattress support panel 30. The floor 670 has a top surface 700, a bottom surface 705 and surrounding side edges 710 and is attached to the front wall 675, back wall 680, first side wall 685 and second side wall 690 at the surrounding side edges 710. The mattress support panel 30 has an upper surface 60, a lower surface 65, an outer perimeter 70 and is removably attached to the front wall 675, back wall 680, first side wall 685 and second side wall 690 at the outer perimeter 70 and is spaced upwardly from the floor 670. A mattress pad 75 is provided. The mattress pad 75 has an upper surface 80, a lower surface 85 and is sized and shaped to fit slidably between the front wall 675, back wall 680, first side wall 685 and second side wall 690.

A rigid frame 730 is provided. The frame 730 is formed at the top 665 by front 735 and rear 740 upper parallel horizontal rails, first 745 and second 750 upper side horizontal rails, two upper front corner members 755, 760 and two upper rear corner members 765, 770 in cooperation therewith. The frame 730 is formed adjacent the floor 670 by front 775 and rear 780 lower parallel horizontal rails and first side 785 and second side 790 lower parallel horizontal rails in cooperation therewith, a pair of front vertical rails 795, 800 and a pair of rear vertical rails 805, 810 in further cooperation with the two upper front corner members 755, 760 and the two upper rear corner members 765, 770 and the four lower corner leg members 815, 816, 817, 818. The rigid frame 730 supports the floor 670, the front wall 675, the back wall 680, the first side wall 685 and the second side wall 690. Each upper front corner member 755, 760 is constructed of two reversibly separable complementary sections 820, 825. The first of the sections 820 is fixedly attached to an end 830 of the front upper horizontal rail 735 and the second of the sections 825 is fixedly attached to an upper end 835 of one of the front vertical rails 795, 800. The upper front corner members 755, 760 support the upper front horizontal rail 735 in a first position 840.

Receiving means 845 are fixedly attached to each front vertical rail 795, 800 for receiving the first section 820 of an upper front corner member 755, 760 and reversibly maintaining the upper front horizontal rail 735 in at least one lower second position 850, thereby lowering the front wall 675 and maintaining structural rigidity of the co-sleeper 10 when the upper front horizontal rail 735 is in one of the second positions 850. A securing strap assembly 115 is provided for securing the co-sleeper 10 to a parental bed 120. When the upper front horizontal rail 735 and the front wall 675 are in the raised first position 840, the co-sleeper 10 is usable as a bassinet; and when the upper front horizontal rail 735 and the front wall 675 are then lowered to one of the second positions 850, the co-sleeper 10 is usable as a changing table. Further, when the securing strap assembly 115 is properly positioned and the co-sleeper 10 is secured to the parental bed 120 it will serve as a co-sleeper 10.

Figure 5:
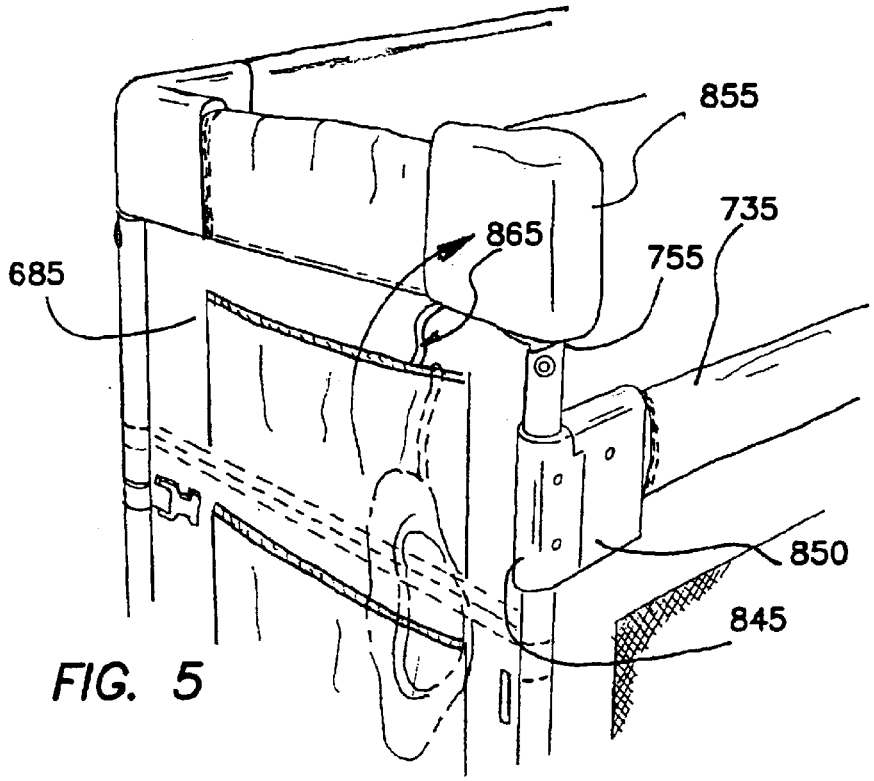
FIG. 5 is a perspective view of the co-sleeper illustrating the padded covers and means for attaching the padded covers to the side walls.
Figure 20:
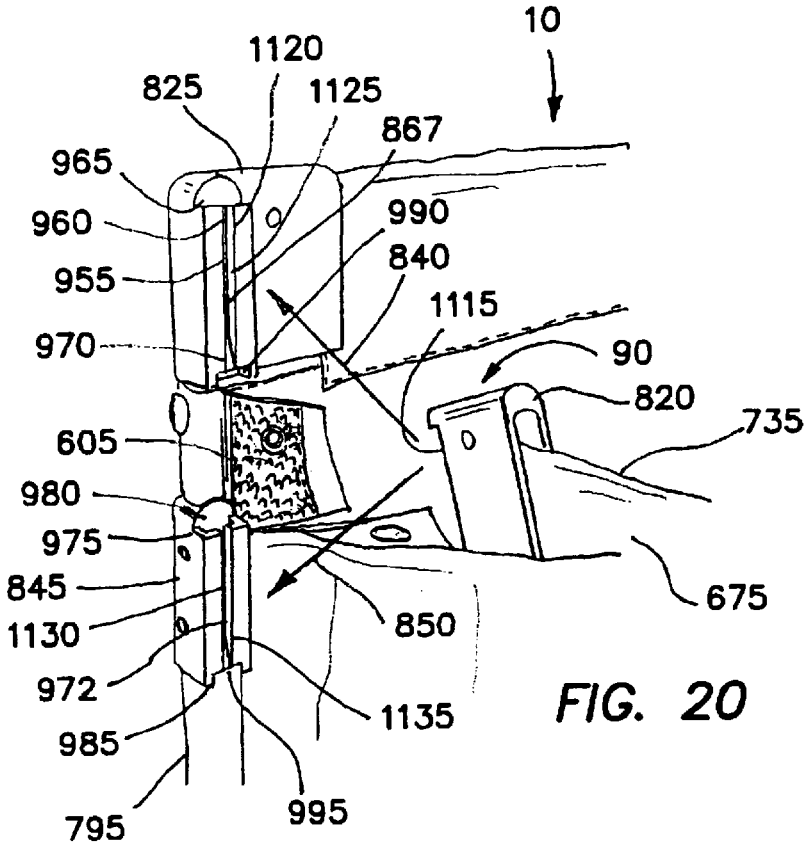
FIG. 20 is a perspective detail view of the means for reversibly lowering the height of at least a portion of the front wall.

(37) In still another variant, as shown in FIGS. 2, 5 and 20, first 855 and second 860 padded covers are provided. Each of the padded covers 855, 860 is sized and shaped to fit over one of the two upper front corner members 755, 760. Means 865 are provided for attaching the first 855 and second 860 padded covers to the first 685 and second 690 side walls. When the upper front horizontal rail 735 is in the second position 850 and the first 855 and second 860 padded covers are installed over the upper front corner members 755, 760, openings 867, 868 in the corner members 755, 760 will be covered and thus protected from entry by fingers of infants or small children (not shown).

Figure 22:
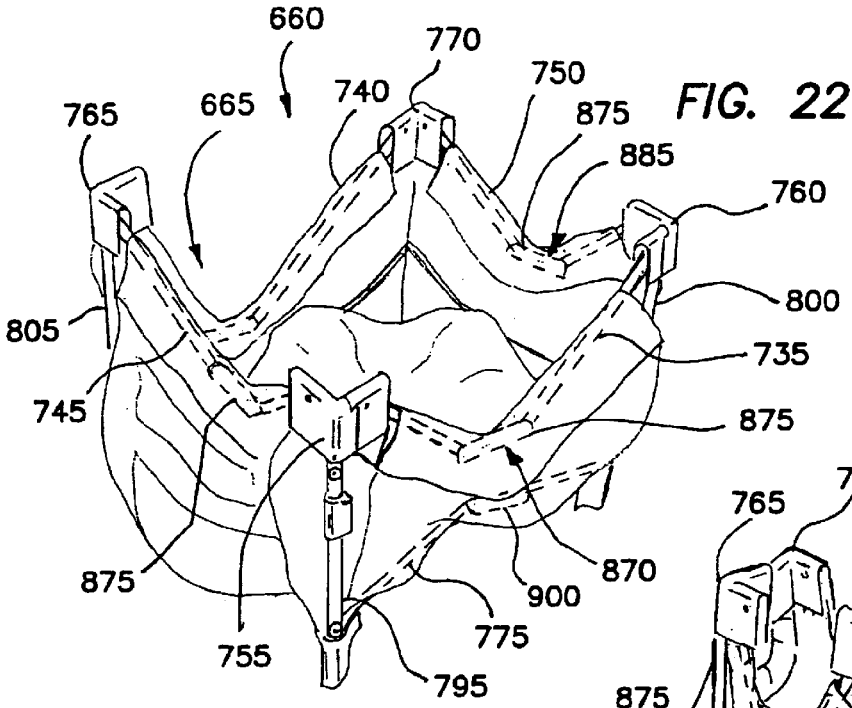
FIG. 22 is a perspective view of the FIG. 1 embodiment in partially collapsed condition.
Figure 23:
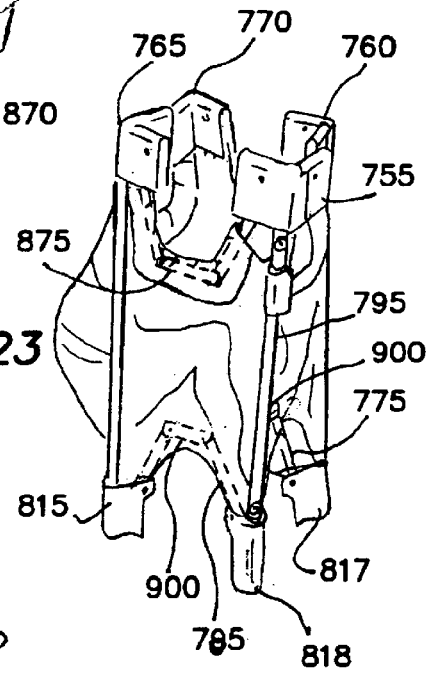
FIG. 23 is a perspective view of the FIG. 1 embodiment in further collapsed condition.

(38) In yet another variant, as shown in FIG. 22, the front 735 and rear 740 upper parallel horizontal rails and first 745 and second 750 upper side horizontal rails are padded.

(39) In a further variant, as shown in FIG. 18, the floor 670 includes a series of first reinforcing straps 125. The first reinforcing straps 125 are located on the bottom surface 705 of the floor 670. At least two of the first reinforcing straps 125 are attached to the rigid frame 730.

(40) In still a further variant, as shown in FIGS. 3 and 18, the floor 670 includes at least two fastening portions 130 extending outwardly from the first reinforcing straps 125 and attaching to the rigid frame 730. At least two securing portions 135 are provided. The securing portions 135 attach the fastening portions 130 to lower edges 869 of the front wall 675, the back wall 680, the first side wall 685 and the second side wall 690.

(41) In yet a further variant, as shown in FIG. 15, the floor 670 includes means 150 for removably securing the lower surface 85 of the mattress pad 75 to the top surface 700 of the floor 670.

(42) In another variant of the invention, as shown in FIG. 15, the mattress support panel 30 is formed of mesh material 155.

(43) In still another variant, as shown in FIGS. 16 and 16A, the mattress support panel 30 includes a series of reinforcing panels 160. The reinforcing panels 160 are attached to the upper surface 60 of the mattress support panel 30. A series of second reinforcing straps 165 is provided. The second reinforcing straps 165 are attached to the lower surface 65 of the mattress support panel 30.

(44) In a further variant, as shown in FIGS. 7, 9, 12 and 12A, spacing of the mattress support panel 30 upwardly from the floor 670 is adjustable between a first, lower position 170 to at least one second higher position 175. This permits the mattress pad 75 to be maintained at at least two different heights relative to an upper mattress surface 177 of the parental bed 120.

(45) In still a further variant, as shown in FIG. 12, the mattress support panel 30 is removably attached to the front wall 675, the back wall 680, the first side wall 685 and the second side wall 690 at the outer perimeter 70 using a first zipper 180.

(46) In yet a further variant, as shown in FIG. 12A, means 185 are provided for securing an openable end 190 of the first zipper 180.

(47) In another variant, as shown in FIGS. 12 and 12A, the means 185 for securing an openable end 190 of the first zipper 180 includes a first reversibly separable securing tab 195. The first securing tab 195 is attached to a zipper pull 200 of the first zipper 180. A zipper pull cover 205 is provided. The zipper pull cover 205 has a side edge 210, a top surface 215, a bottom surface 220 and a first reversibly separable pad 225 attached to the bottom surface 220. The zipper pull cover 205 is attached at the side edge 210 to an inner surface 230 of either of the front wall 675, the back wall 680, the first side wall 685 and the second side wall 690 adjacent the openable end 190 of the first zipper 180. A second reversibly separable attachment pad 235 is provided. The second attachment pad 235 is attached to the upper surface 60 of the mattress support panel 30 adjacent the openable end 190 of the first zipper 180. When the first zipper 180 is in a closed position 240, the first reversibly separable pad 225 of the zipper pull cover 205 will attach to the first securing tab 195 and the second reversibly separable attachment pad 235, thereby preventing easy opening of the first zipper 180.

(48) In still another variant, as shown in FIG. 12A, a flexible covering 243 is provided for an upper portion 245 of the first zipper 180 to prevent injury to an infant or small child (not shown).

(49) In yet another variant, as shown in FIGS. 7, 8, 9, 10 and 12A, the mattress support panel 30 includes a surrounding edge panel 250. The surrounding edge panel 250 extends upwardly from the outer perimeter 725 for a first predetermined distance 255 and has an upper edge 260. A second zipper 265 is provided. The second zipper 265 removably attaches the surrounding edge panel 250 either to the front wall 675, the back wall 680, the first side wall 685 and the second side wall 690 at the upper edge 260. When the second zipper 265 attaches the upper edge 260 to the front wall 675, the back wall 680, the first side wall 685 and the second side wall 690 the mattress support panel 695 will be located on the first lower position 170. When the first zipper 180 also attaches the outer perimeter 725 to the front wall 675, the back wall 680, the first side wall 685 and the second side wall 690 the mattress support panel 695 will be located on the second higher position 175.

(50) In a further variant, as shown in FIGS. 12A and 12B, means 270 are provided for securing an openable end 275 of the second zipper 265.

(51) In still a further variant, the means 270 for securing an openable end 275 of the second zipper 265 includes a second reversibly separable securing tab 280. The second securing tab 280 attaches to a zipper pull 285 of the second zipper 265. A zipper pull cover 205 is provided. The zipper pull cover 205 has a side edge 210, a top surface 215, a bottom surface 220 and a first reversibly separable pad 225 attached to the bottom surface 220. The zipper pull cover 205 is attached at the side edge 210 to an inner surface 230 of either of the front wall 675, the back wall 680, the first side wall 685 and the second side wall 690 adjacent the openable end 275 of the second zipper 265. A third reversibly separable attachment pad 290 is provided. The third attachment pad 290 is attached adjacent the upper edge 260 of the surrounding edge panel 250 adjacent the openable end 275 of the second zipper 265. When the second zipper 265 is in a closed position 295, the first reversibly separable pad 225 of the zipper pull cover 205 will attach to the second securing tab 280 and the third reversibly separable attachment pad 290, thereby preventing easy opening of the second zipper 265.

(52) In yet a further variant of the invention, a flexible covering 243 is provided for an upper portion 305 of the second zipper 265 to prevent injury to an infant or small child (not shown).

(53) In another variant, as shown in FIG. 16, the mattress support panel 30 includes means 310 for removably securing the lower surface 85 of the mattress pad 75 to the upper surface 60 of the mattress support panel 30.

(54) In still another variant, as shown in FIG. 1A, the mattress pad 75 includes means 315 for removably securing the lower surface 85 of the mattress pad 75 to either the upper surface 60 of the mattress support panel 30 or the top surface 700 of the floor 670.

(55) In yet another variant, as shown in FIGS. 11 and 11A, the mattress pad 75 includes a washable cover 320. The washable cover 320 is sized and shaped to fit over the mattress pad 75. Means 325 are provided for removably securing the washable cover 320 to the lower surface 85 of the mattress pad 75. The washable cover 320 has means 325 for being removably secured to the lower surface 85 of the mattress pad 75 and means 330 for being removably secured to the upper surface 60 of the mattress support panel 30.

(56) In a further variant, as shown in FIG. 3, at least a portion of either of the front wall 675, the back wall 680, the first side wall 685 and the second side wall 690 is formed of mesh material 375.

(57) In still a further variant, as shown in FIG. 3, the back wall 680 includes a reclosable opening 380. The reclosable opening 380 provides access to a space 385 between the floor 670 and the mattress support panel 30.

(58) In yet a further variant, as shown in FIGS. 2 and 19, the co-sleeper 10 includes height-adjusting means 390 for changing a height 395 of the co-sleeper 10 such that the upper surface 60 of the mattress support panel 30 is located on at a level 400 below an upper surface 405 of a mattress 410 of the parental bed 120.

(59) In yet another variant, as shown in FIGS. 2, 3 and 19, the height adjusting means 390 includes extensions 415 that attach to the four lower corner leg members 815, 816, 817, 818.

(60) In still another variant, as shown in FIGS. 2, 3 and 19, removable wheels 425 are provided. The wheels 425 attach to either of four lower corner leg members 815, 816, 817, 818 and the extensions 415.

(61) In a further variant, as shown in FIG. 4, the co-sleeper 10 includes at least one pair of alignment means 430 through which the securing strap assembly 115 is directed for maintaining the securing strap assembly 115 in horizontal orientation and preventing lifting or bucking of the co-sleeper 10 when secured to the parental bed 120. The co-sleeper 10 also includes at least one pair of securing strap attachment means 435 for fastening the securing strap assembly 115 to the co-sleeper 10.

(62) In still a further variant, as shown in FIG. 4, the securing strap assembly 115 includes a strap member 440 that has a first end 445 and a second end 450. A resistance plate member 455 is provided that has at least two slots 460 vertically aligned and centrally located on at which the strap member 440 is attached such that the first end 445 and the second end 450 are equidistant from the plate member 455. Attachment cooperation means 465 are provided that are located at the first end 445 and the second end 450 of the strap member 440 for reversible connection to one of the pairs of securing strap attachment means 435. Adjusting means 470 are provided for adjusting a length 475 of the strap member 440 and tightening it after connecting the attachment cooperation means 465 to one of the pairs of security strap attachment means 435. The strap member 440 is properly positioned when located under a mattress 410 and above a surface 485 on which the mattress 410 rests on the parental bed 120. The strap member 440 is held in place by the resistance plate member 455 located vertically at a side 490 of the parental bed 120 opposite placement of the co-sleeper 10. The strap member 440 is tightened so the co-sleeper 10 is held fast to the parental bed 120.

(63) In another variant of the invention, as shown in FIG. 2, the front wall 675 is comprised of flexible material 495 and means 500 for supporting the flexible material 495.

(64) In still another variant, as shown in FIGS. 1 and 2, means 505 are provided for constraining a portion 510 of the flexible material 495 when the front wall 675 is lowered from the first position 105 at the top 665 to one of the second positions 110 below the top 665.

(65) In yet another variant, as shown in FIGS. 2A and 6, the means 505 for constraining a portion 510 of the flexible material 495 includes a first strap portion 515. The first strap portion 515 has a first end 520 and a second end 525 and is attached at the first end 520 to an inner surface 530 of the front wall 675 at a level 532 below the at least one second position 110. A receiving connector 535 is provided. The receiving connector 535 is attached to the first strap portion 515 at the second end 525. A second strap portion 540 is provided. The second strap portion 540 has a first end 545 and a second end 547 and is attached at the first end 545 to an outer surface 550 of the front wall 675 at a level 555 below the at least one second position 110. An attaching connector 560 is provided. The attaching connector 560 has a slot 565. The slot 565 is sized and shaped to fit slidably over the second strap portion 540. The second strap portion 540 is looped through the slot 565 of the attaching connector 560 and removably attached to itself 540 with a slidable adjusting buckle 570. When the front wall 675 is in one of the second positions 110 and the attaching connector 560 is located in the receiving connector 535, the slidable adjusting buckle 570 may be moved to tighten the first 515 and second 540 strap portions so as to constrain the portion 510 of the flexible material 495.

(66) In still another variant, as shown in FIGS. 2A and 6, an inside pocket 575 is provided. The inside pocket 575 has a reversibly closable top opening 580 and is located on the inner surface 530 of the front wall 675 with the first end 520 of the first strap portion 515 attached to the front wall 675 within the inside pocket 575. An outside pocket 585 is provided. The outside pocket 585 has a reversibly closable top opening 590 and is located on the outer surface 550 of the front wall 675 with the first end 545 of the second strap portion 540 attached to the front wall 675 within the outside pocket 585. When the first 515 and second 540 strap portions with attached receiving 535 and attaching 560 connectors are not needed to constrain the portion 510 of the flexible material 495, the strap portions 515, 540 are stored within the inside 575 and outside 585 pockets, respectively.

(67) In yet another variant, as shown in FIG. 1, a portion 595 of the front wall 675 is formed of mesh material 600.

(68) In a further variant, as shown in FIGS. 1A, 13, 14, 22, 23 and 24, the rigid frame 730 includes means 870 for pivotally mounting the front 735 and rear 740 upper horizontal rails to the upper front corner members 755, 760 and upper rear corner members 765, 770, respectively. Frame locking devices 875 positioned at center points 880 of the front 735 and rear 740 upper horizontal rails are pivotally mounted to the rails 735, 740 permitting the upper rails 735, 740 to pivot downwardly from the open top 665 of the enclosure 660. Means 885 are provided for pivotally mounting the first 745 and second 750 upper side horizontal rails to the upper front 755, 760 and rear 765, 770 corner members. Frame locking devices 875 positioned at center points 890 of the first 745 and second 750 upper side horizontal rails are pivotally mounted to the rails 745, 750 permitting each of the rails 745, 750 to pivot downwardly from the open top 665 of the enclosure 660.

Means 895 are provided for pivotally mounting the first side 785 and second side 790 lower horizontal rails to the lower corner leg members 815, 816, 817, 818. Frame pivoting devices 900 positioned at center points 905 of the first side 785 and second side 790 lower horizontal rails are pivotally mounted to the rails 785, 790 permitting each of the rails 785, 790 to pivot upwardly. Means 910 are provided for pivotally mounting the front 775 and rear 780 lower horizontal rails to the lower corner leg members 815, 816, 817, 818, respectively. Frame pivoting devices 900 positioned at center points 915 of the front 775 and rear 780 lower horizontal rails are pivotally mounted to the rails 775, 780 permitting each of the rails 775, 780 to pivot upwardly. The frame 730 may be quickly folded into a compact package 920 for transport and storage by releasing the locking devices 875 positioned on the front 735 and rear 740 upper horizontal rails and first 745 and second 750 upper side horizontal rails, depressing the upper horizontal rails 735, 740, 745, 750 downwardly while pulling upwardly on the frame pivoting devices 900 on the lower horizontal rails 775, 780, 785, 790, thereby causing the upper 735, 740, 745, 750 horizontal rails to bend downwardly, the lower horizontal rails 775, 780, 785, 790 to bend upwardly and the vertical rails 795, 800, 805, 810 to move inwardly.

(69) In still a further variant, as shown in FIGS. 11 and 24, the mattress pad 75 includes at least three portions 333. Each of the portions 333 has a rigid bottom section 335 and a padded top section 340. The portions 333 are hingedly attached to each other. Means 345 are provided for removably attaching outer edges 350 of the mattress pad 75 together. The mattress pad 75 serves as an enclosure 355 for the co-sleeper 10 when folded for transport and storage.

(70) In yet a further variant, as shown in FIG. 17, the mattress pad 75 further comprises a slat-receiving pocket 360 and a stiffening slat 365. The slat receiving pocket 360 extends across the bottom sections 335 of the at least three portions 333 and is sized and shaped to receive the stiffening slat 365 for further supporting the mattress pad 75.

Figure 21:
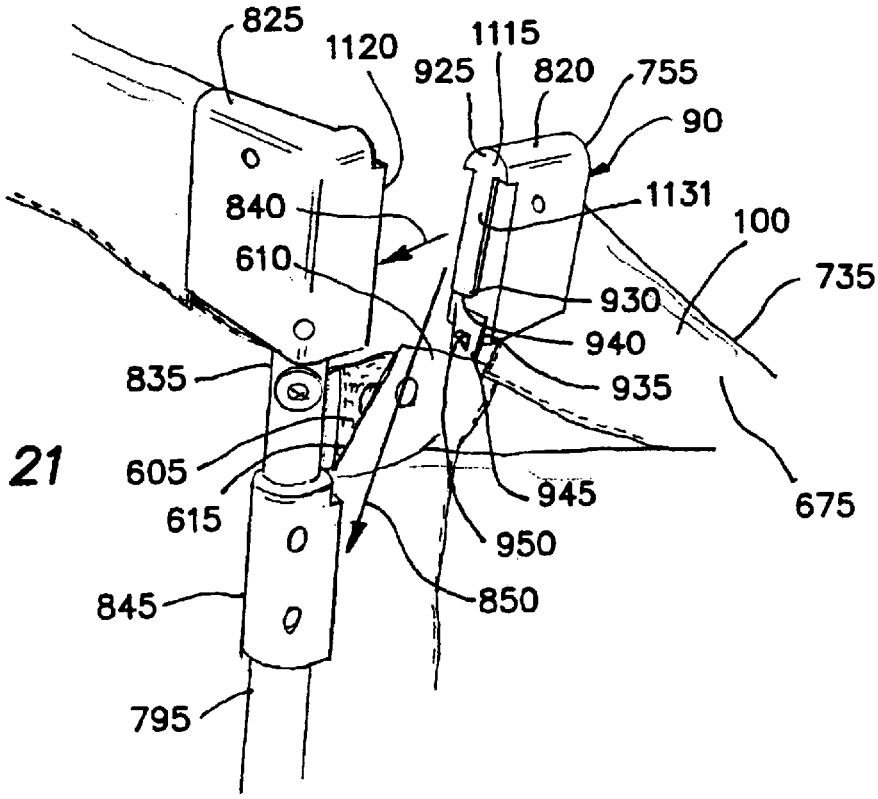
FIG. 21 is a perspective detail view of the means for reversibly lowering the height of at least a portion of the front wall illustrating the T-shaped protrusion and the securing extension of the first section of the upper front corner member.

(71) In another variant of the invention, as shown in FIGS. 2, 20 and 21, the means 90 for reversibly lowering the height 95 of at least a portion 100 of the front wall 675 includes a first set of reversibly separable fasteners 605 located adjacent a top edge 610 of the front wall 675 adjacent a first side edge 615 of the front wall 675. A second set of reversibly separable fasteners 620 is located adjacent the top edge 610 of the front wall 675 adjacent a second side edge 625 of the front wall 675. When the front wall 675 is lowered from the first, upper position 105 to one of the second lower positions 110, the reversibly separable fasteners 605, 620 are opened to permit the front wall 675 to be lowered while securing any excessive flexible material 630 when the front wall 675 is in the first upper position 105.

(72) In yet another variant, as shown in FIGS. 1, 20 and 21, the first 820 and second 825 sections of the upper front corner members 755, 760 and the receiving means 845 fixedly attached to each front vertical rail 795, 780 for receiving the first section 820 of the upper front corner members 755, 760 and reversibly maintaining the upper front horizontal rail 735 in at least one lower second position 850 include a T-shaped protrusion 925 extending from a point 930 adjacent a lower end 935 of the first section 820 of the upper front corner members 755, 760 toward an upper end 937 of the first section 820 terminating in a stop 940. A securing extension 945 located on the first section 820 adjacent and below the T-shaped protrusion 925 is provided. The securing extension 945 is bendable away from the T-shaped protrusion 925 and includes a retaining ledge 950. A first mating T-shaped slot 955 is provided. The T-shaped slot 955 extends from a point 960 adjacent an upper end 965 of the second section 825 of the upper front corner member 755, 760 and terminates above a lower end 970 of the upper front corner members 755, 760.

A second mating T-shaped slot 972 extends from a point 975 adjacent an upper end 980 of the receiving means 845 toward a lower end 985 of the receiving means 845 and terminates above a lower end 985 of the receiving means 845. At least two locating features 990, 995 are provided. The locating features 990, 995 are positioned on the second section 825 and the receiving means 845 adjacent and below the first 955 and second 972 T-shaped slots. The locating features 990, 995 are sized, shaped and located to be removably engaged by the retaining ledge 950 of the securing extension 945 so that the first section 820 of the upper front corner member 755, 760 may be secured to either the second section 825 or the receiving means 845.

Figure 13:
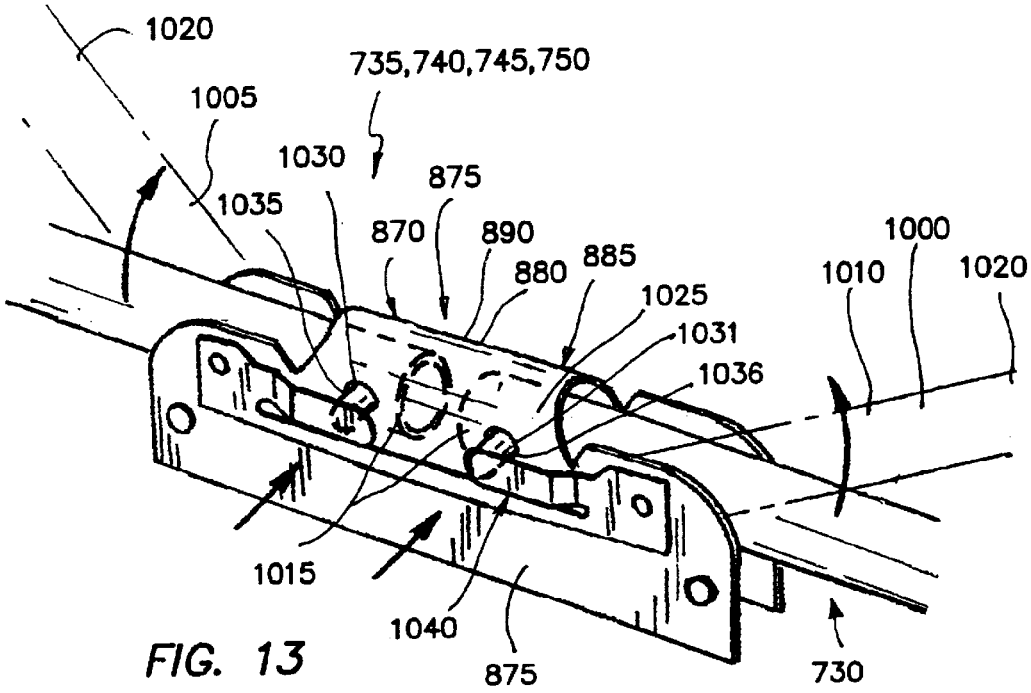
FIG. 13 is a perspective view of the frame locking device.

(73) In still another variant; as shown in FIG. 13, the rigid frame 730 is formed of hollow tubing 1000. The front 735, rear 740, first side 745 and second side 750 upper horizontal rails each have a first portion 1005 and a second portion 1010. Each portion 1005, 1010 has an inboard end 1015 and an outboard end 1020, and the frame locking devices 875 positioned at center points 880, 890 of the upper horizontal rails 735, 740, 745, 750 include a connecting frame 1025. The frame 1025 is pivotally mounted to the inboard ends 1015 of each of the first 1005 and second 1010 portions of the upper horizontal rails 735, 740, 745, 750. The connecting frame 1025 includes a pair of locking holes 1030, 1031. A pair of spring-loaded buttons 1035, 1036 are mounted within the upper horizontal rails 735, 740, 745, 750. The buttons 1035, 1036 are sized, shaped and located to engage the locking holes 1030, 1031 in the connecting frame 1025 when the first 1005 and second 1010 portions of the upper horizontal rails 735, 740, 745, 750 are collinear. Means 1040 are provided for pushing both buttons 1035, 1036 inwardly so as to clear the locking holes 1030, 1031 in the connecting frame 1025 simultaneously, thereby permitting the upper horizontal rails 735, 740, 745, 750 to be pivoted downwardly.

Figure 14:
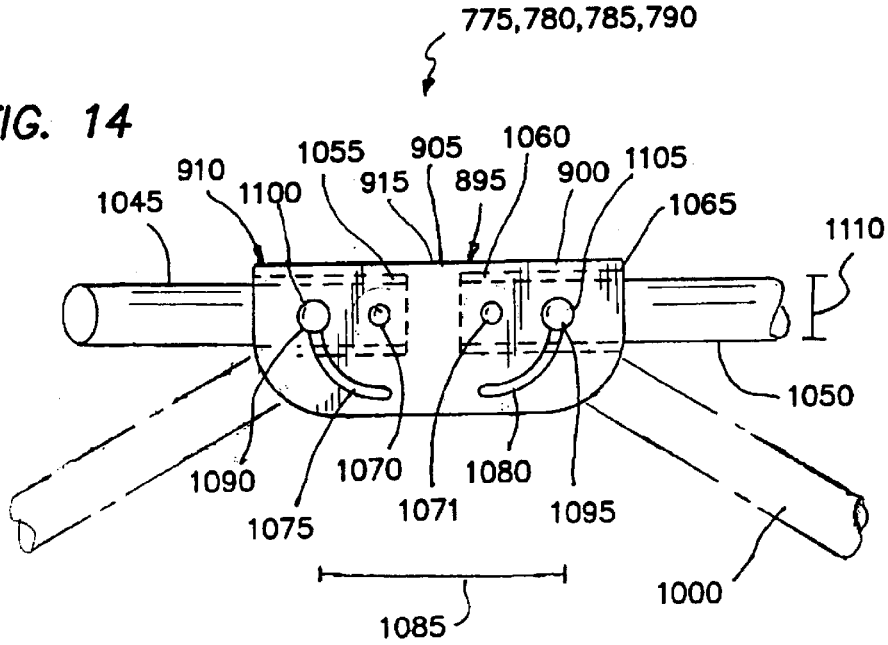
FIG. 14 is a perspective view of the frame pivoting device.

(74) In a further variant, as shown in FIG. 14, the rigid frame 730 is formed of hollow tubing 1000. The front 775, rear 780, first side 785 and second side 790 lower horizontal rails each have a first 1045 portion and a second portion 1050. Each portion 1045, 1050 has an inboard end 1055 and an outboard end 1060. The frame pivoting devices 900 positioned at center points 905, 915 of the lower horizontal rails 775, 780, 785, 790 include a spring housing 1065. The spring housing 1065 is pivotally mounted upon a pair of mounting pins 1070, 1071 to the inboard ends 1055 of each of the first 1045 and second 1050 portions of the lower horizontal rails 775, 780, 785, 790. The spring housing 1065 includes first 1075 and second 1080 pairs of arcurate alignment slots and first 1090 and second 1095 pairs of positioning detents. First 1100 and second 1105 alignment pins are provided. The alignment pins 1100, 1105 are mounted parallel to the mounting pins 1070, 1071 and spaced outwardly from the inboard ends 1055 of the first 1045 and second 1050 portions of the lower horizontal rails 775, 780, 785, 790. The alignment pins 1100, 1105 are sized, shaped and located to fit slidably within the arcurate alignment slots 1075, 1080. Each of the pairs 1090, 1095 of positioning detents is spaced apart by a distance 1085 slightly less than a diameter 1110 of one of the lower horizontal rails 775, 780, 785, 790. When the first 1045 and second 1050 portions of the lower horizontal rails 775, 780, 785, 790 are collinear, the rails 775, 780, 785, 790 will be within the spring housing 1065 and when the rails 775, 780, 785, 790 are pivoted with respect to one another to fold the co-sleeper 10, the detents 1090, 1095 will be urged against the rails 775, 780, 785, 790 by a spring resistance of the housing 1065, causing the housing 1065 to spread apart, such resistance serving to maintain collinear alignment of the lower horizontal rails 775, 780, 785, 790 when the co-sleeper 10 is erected.

(75) In a further variant, as shown in as shown in FIGS. 20 and 21, the first section 820 of the front upper corner member 755, 760 is a male section 1115 and the second section 825 is a female section 1120. The second section 825 has an opening 1125 sufficiently small so as to prevent entry of fingers of small children or infants (not shown).

(76) In a final variant of the invention, as shown in FIGS. 20 and 21, the receiving means 845 is a female section 1130 for association with a male section 1131. The receiving means 845 has an opening 1135 sufficiently small so as to prevent the entry of fingers of small children or infants (not shown).

While one embodiment of the present invention has been illustrated and described in detail, it is to be understood that this invention is not limited thereto and may be otherwise practiced within the scope of the following claims.

What is claimed is:

1. A portable combination bedside co-sleeper, comprising:

an enclosure having an open top, a floor, a mattress support panel, a front wall, and at least one surrounding wall connected to the front wall;

said floor having a top surface, a bottom surface and surrounding side edges and being attached to said front wall and said surrounding wall at said surrounding side edges;

said mattress support panel having an upper surface, a lower surface, an outer perimeter and being removably attached to said front wall and said surrounding wall at said outer perimeter and being spaced upwardly from said floor;

a mattress pad, said mattress pad having an upper surface, a lower surface and being sized and shaped to fit slidably between said front wall and said surrounding wall;

means for reversibly' lowering a height of at least a portion of said front wall, from a first position at said trop to at least one second position below said top; and a securing strap assembly for securing the co-sleeper to a parental bed;

whereby, when the front wall is raised to the first position, the co-sleeper is usable as a bassinet; and wherein, when the front wall is then lowered to one of its second positions, the co-sleeper is usable as a changing table; and further, when the securing strap assembly is properly positioned and the co-sleeper is secured to the parental bed it will serve as a co-sleeper;

wherein said mattress support panel further comprises:

a series of reinforcing panels, said reinforcing panels being attached to said upper surface; and a series of second reinforcing straps, said second reinforcing straps being attached to said lower surface.

2. A portable combination bedside co-sleeper, comprising:

an enclosure having an open top, a floor, a mattress support panel, a front wall, and at least one surrounding wall connected to the front wall;

said floor having a top surface, a bottom surface and surrounding side edges and being attached to said front wall and said surrounding wall at said surrounding side edges;

said mattress support panel having an upper surface, a lower surface, an outer perimeter and being removably attached to said from wall and said surrounding wall at said outer perimeter and being spaced upwardly from said floor;

a mattress pad, said mattress pad having an upper surface, a lower surface and being sized and shaped to fit slidably between said front wall and said surrounding wall;

means for reversibly' lowering a height of at least portion of said front wall, from a first position at said trop to at least one second position below said top; and a securing strap assembly for securing the co-sleeper to a parental bed; and whereby, when the front wall is raised to the first position, the co-sleeper is usable as a bassinet; and wherein, when the front wall is then lowered to one of its second positions, the co-sleeper is usable as a changing table; and further, when the securing strap assembly is properly positioned and the co-sleeper is secured to the parental bed it will serve as a co-sleeper;

wherein said mattress support panel is removably attached to said front wall and said surrounding wall at said outer perimeter using a first zipper.

3. A portable combination bedside co-sleeper, as described in claim 2, further comprising means for securing an openable end of said first zipper.

4. A portable combination bedside co-sleeper, as described in claim 3, wherein said means for securing an openable end of said first zipper further comprises:

a first reversibly separable securing tab, said first securing tab attached to a zipper pull of said first zipper;

a zipper pull cover, said zipper pull cover having a side edge, a top surface, a bottom surface and a first reversibly separable pad attached to said bottom surface;

said zipper pull cover being attached at said side edge to an inner surface of either of said front wall and said surrounding wall adjacent said openable end of said first zipper;

a second reversibly separable attachment pad attached to said upper surface of said mattress support panel adjacent said openable end of said first zipper; and whereby, when said first zipper is in a closed position, said first reversibly separable pad of said zipper pull cover will attach to said first securing tab and said second reversibly separable attachment pad, thereby preventing easy opening of said first zipper.

5. A portable combination bedside co-sleeper, as described in claim 2, further comprising a flexible covering for an upper portion of said first zipper to prevent injury to an infant or small child.

6. A portable combination bedside co-sleeper, as described in claim 4, wherein said mattress support panel further comprises:

a surrounding edge panel, said surrounding edge panel extending upwardly from said outer perimeter for a first predetermined distance and having an upper edge;

a second zipper, said second zipper removably attaching said surrounding edge panel to said front wall and said surrounding wall at said upper edge; and whereby, when said second zipper attaches said upper edge to said front wall and said surrounding wall said mattress support panel will be disposed at said first lower position, and when said first zipper also attaches said outer perimeter to said front wall and said surrounding wall said mattress support panel will be disposed at one of said second higher positions.

7. A portable combination bedside co-sleeper, as described in claim 6, further comprising means for securing an openable end of said second zipper.

8. A portable combination bedside co-sleeper., as described in claim 7, wherein said means for securing an openable end of said second zipper further comprises:

a second reversibly separable securing tab, said second securing tab attached to a zipper pull of said second zipper;

said zipper pull cover being attached at said side edge to an inner surface of either of said front wall and said surrounding wall adjacent said openable ends of said first zipper and said second zipper;

a third reversibly separable attachment pad attached adjacent said upper edge of said surrounding edge panel adjacent said openable end of said second zipper; and whereby, when said second zipper is in a closed position, said first reversibly separable pad of said zipper pull cover will attach to said second securing tab and said third reversibly separable attachment pad, thereby preventing easy opening of said second zipper.

9. A portable combination bedside co-sleeper, as described in claim 6, further comprising a flexible covering for upper portion of said second zipper to prevent injury to an infant or small child.

10. A portable combination bedside co-sleeper, comprising:

an enclosure having an open top, a floor, a mattress support panel, a front wall, and at least one surrounding wall connected to the front wall;

said floor having a top surface, a bottom surface and surrounding side edges and being attached to said front wall and said surrounding wall at said surrounding side edges;

said mattress support panel having an upper surface, a lower surface, an outer perimeter and being removably attached to said front wall and said surrounding wall at said outer perimeter and being spaced upwardly from said floor;

a mattress pad, said mattress pad having an upper surface, a lower surface and being sized and shaped to fit slidably between said front wall and said surrounding wall;

means for reversibly lowering a height of at least a portion of said front wall, from a first position at said trop to at least one second position below said top;

a securing strap assembly for securing the co-sleeper to a parental bed; and whereby, when the front wall is raised to the first position, the co-sleeper is usable as a bassinet; and wherein, when the front wall is then lowered to one of its second positions, the co-sleeper is usable as a changing table; and further, when the securing strap assembly is properly positioned and the co-sleeper is secured to the parental bed it will serve as a co-sleeper;

wherein said mattress pad further comprises:

at least three portions, each of said portions having a rigid bottom section and a padded top section, said portions being hingedly attached to each other; and means for removably attaching outer edges of said mattress pad together; and whereby, said mattress pad serves as an enclosure for the co-sleeper when folded for transport and storage;

wherein said mattress pad further comprises a slat-receiving pocket and a stiffening slat, said slat receiving pocket extending across said bottom sections of said at least three portions and being sized and shaped to receive said stiffening slat for further supporting said mattress pad.

11. A portable combination bedside co-sleeper, comprising:

an enclosure having an open top, a floor, a mattress support panel, a front wall, and at least one surrounding wall connected to the front wall;

said floor having a top surface, a bottom surface and surrounding side edges and being attached to said front wall and said surrounding wall at said surrounding side edges;

said mattress support panel having an upper surface, a lower surface, an outer perimeter and being removably attached to said front wall and said surrounding wall at said outer perimeter and being spaced upwardly from said floor;

a mattress pad, said mattress pad having an upper surface, a lower surface and being sized and shaped to fit slidably between said front wall and said surrounding wall;

means for reversibly' lowering a height of at least a portion of said front wall, from a first position at said trop to at least one second position below said top;

a securing strap assembly for securing the co-sleeper to a parental bed; and whereby, when the front wall is raised to the first position, the co-sleeper is usable as a bassinet; and wherein, when the front wall is then lowered to one of its second positions, the co-sleeper is usable as a changing table; and further, when the securing strap assembly is properly positioned and the co-sleeper is secured to the parental bed it will serve as a co-sleeper;

wherein said front wall is comprised of flexible material and means for supporting said flexible material; and further comprising means for constraining a portion of said flexible material when said front wall is lowered from said first portion at said top to one of said second positions below said top;

wherein said means for constraining a portion of said flexible material comprises:

a first strap portion, said first strap portion having first end and a second end and being attached at said first end to an inner surface of said front wall at a level below said at least one second position;

a receiving connector, said receiving connector being attached to said first strap portion at said second end;

a second strap portion, said second strap portion having a first end and a second end and being attached at said first end to an outer surface of said front wall at a level below said at least one second position;

an attaching connector, said attaching connector having a slot, said slot being sized and shaped to fit slidably over said second strap portion;

said second strap portion being looped through said slot of said attaching connector and removably attached to itself with a slidable adjusting buckle; and whereby, when said front wall is in one of said second positions and said attaching connector is disposed in said receiving connector, said slidable adjusting buckle is moved to tighten said first and second strap portions so as to constrain said portion of said flexible material.

12. A portable combination bedside co-sleeper, as described in claim 11, further comprising:

an inside pocket, said inside pocket having a reversibly closable top opening and being disposed upon said inner surface of said front wall with said first end of said first strap portion attached to said front wall within said inside pocket;

an outside pocket, said outside pocket having a reversibly closable top opening and being disposed upon said outer surface of said front wall with said first end of said second strap portion attached to said front wall within said outside pocket; and whereby, when said first and second strap portions with attached receiving and attaching connectors are not needed to constrain said portion of said flexible material, said strap portions are stored within said inside and outside pockets, respectively.

13. A portable combination bedside co-sleeper, comprising:

an enclosure having an open top, a floor, a mattress support panel, a front wall, and at least one surrounding wall connected to the front wall;

said floor having a top surface, a bottom surface and surrounding side edges and being attached to said front wall and said surrounding wall at said surrounding side edges;

said mattress support panel having an upper surface, a lower surface, an outer perimeter and being removably attached to said front wall and said surrounding wall at said outer perimeter and being spaced upwardly from said floor;

a mattress pad, said mattress pad and having an upper surface, a lower surface and being sized and shaped to fit slidably between said front wall and said surrounding wall;

means for reversibly' lowering a height of at least portion of said front wall, from a first position at said trop to at least one second position below said top;

a securing strap assembly for securing the co-sleeper to a parental bed;

at least one lower mattress control slit, said lower mattress control slit penetrating said floor;

at least one lower releasable attachment means, said lower releasable attachment means disposed upon said bottom surface of said floor adjacent said lower mattress control slit;

at least one attachment strip, said attachment strip being attached to said lower surface of said mattress pad, being sized and shape to fit slidably through said lower mattress control slit and having means for attaching to said lower releasable attachment means; and whereby, when said mattress pad is disposed upon said floor, said attachment strip is disposed through said lower mattress control slit and attached to said lower releasable attachment means, said mattress pad will be removably secured to said floor;

whereby, when the front wall is raised to the first position, the co-sleeper is usable as a bassinet; and wherein, when the front wall is then lowered to one of its second positions, the co-sleeper is usable as a changing table; and further, when the securing strap assembly is properly positioned and the co-sleeper is secured to the parental bed it will serve as a co-sleeper.

14. A portable combination bedside, co-sleeper comprising:

a rigid enclosure having an open top, a floor, a front wall, a back wall, a first side wall, a second side wall and a mattress support panel;

said floor having a top surface, a bottom surface and surrounding side edges and being attached to said front wall, back wall, first side wall and second side wall at said surrounding side edges;

said mattress support panel having an upper surface, a lower surface, an outer perimeter and being removably attached to said front wall, back wall, first side wall and second side wall at said outer perimeter and being spaced upwardly from said floor;

a mattress pad, said mattress pad having an upper surface, a lower surface and being sized and shaped to fit slidably between said front wall, back wall, first side wall and second side wall;

a rigid frame, said frame being formed at the top by front and rear upper parallel horizontal rails and first and second user side horizontal rails and two upper front corner members and two upper rear corner members in cooperation therewith, and being formed adjacent said floor by front and rear lower parallel horizontal rails and first side and second side lower parallel horizontal rails and in cooperation therewith, and a pair of front vertical rails and a pair of rear vertical rails in further cooperation with said two upper front corner members and said two upper rear corner members and said four lower corner leg members;

said rigid frame supporting said floor, said front wall, said back wall, said first side wall and said second side wall;

each upper front corner member being constructed of two reversibly separable complementary sections, the first of said sections being fixedly attached to an end of said front upper horizontal rail and the second of said sections being fixedly attached to an upper end of one of said front vertical rails, said upper front corner members supporting said upper front horizontal rail in a first position;

receiving means fixedly attached to each front vertical rail for receiving said first section of an upper front corner member and reversibly maintaining said upper front horizontal rail in at least one lower second position, thereby lowering said front wall and maintaining structural rigidity of the co-sleeper when said upper front horizontal rail is in one of said second positions;

a securing strap assembly for securing the co-sleeper to a parental bed; and whereby, when said upper front horizontal rail and said front wall are in the raised first position, the co-sleeper is usable as a bassinet; and wherein, when said upper front horizontal rail and said front wall are the lowered to one of said second positions, the co-sleeper is usable as a changing table; and further, when the securing strap assembly is properly positioned and the co-sleeper is secured to the parental bed it will serve as a co-sleeper;

wherein said mattress support panel further comprises a series of reinforcing panels, said reinforcing panels being attached to said upper surface of said mattress support panel, and a series of second reinforcing straps, said second reinforcing straps being attached to said lower surface of said mattress support panel.

15. A portable combination bedside co-sleeper comprising:

a rigid enclosure having an open top, a floor, a front wall, a back wall, a first side wall, a second side wall and a mattress support panel;

said floor having a top surface, a bottom surface and surrounding side edges and being attached to said front wall, back wall, first side wall and second side wall at said surrounding side edges;

said mattress support panel having an upper surface, a lower surface, an outer perimeter and being removably attached to said front wall, back wall, first side wall and second side wall at said outer perimeter and being spaced upwardly from said floor;

a mattress pad, said mattress pad having an upper surface, a lower surface and being sized and shaped to fit slidably between said front wall, back wall, first side wall and second side wall;

a rigid frame, said frame being formed at the top by front and rear upper parallel horizontal rails and first and second upper side horizontal rails and two upper front corner members and two upper rear corner members in cooperation therewith, and being formed adjacent said floor by front and rear lower parallel horizontal rails and first side and second side lower parallel horizontal rails and in cooperation therewith, and a pair of front vertical rails and a pair of rear vertical rails in further cooperation with said two upper front corner members and said two upper rear corner members and said four lower corner leg members;

said rigid frame supporting said floor, said front wall, said back wall, said first side wall and said second side wall;

each upper front corner member being constructed of two reversibly separable complementary sections, the first of said sections being fixedly attached to an end of said front upper horizontal rail and the second of said sections being fixedly attached to an upper end of one of said front vertical rails, said upper front corner members supporting said upper front horizontal rail in a first position;

receiving means fixedly attached to each front vertical rail for receiving said first section of an upper front corner member and reversibly maintaining said upper front horizontal rail in at least one lower second position, thereby lowering said front wall and maintaining structural rigidity of the co-sleeper when said upper front horizontal rail is in one of said second positions;

a securing strap assembly for securing the co-sleeper to a parental bed;

whereby, when said upper front horizontal rail and said front wall are in the raised first position, the co-sleeper is usable as a bassinet; and wherein, when said upper front horizontal rail and said front wall are then lowered to one of said second positions, the co-sleeper is usable as a changing table; and further, when the securing strap assembly is properly positioned and the co-sleeper is secured to the parental bed it will serve as a co-sleeper; and wherein said mattress support panel is removably attached to said front wall, back wall, first side wall and second side wall at said outer perimeter using a first zipper.

16. A portable combination bedside co-sleeper, as described in claim 15, further comprising means for securing an openable end of said first zipper.

17. A portable combination bedside co-sleeper, as described in claim 16, wherein said means for securing an openable end of said first zipper further comprises:

a first reversibly separable securing tab, said first securing tab attached to a zipper pull of said first zipper;

a zipper pull cover, said zipper pull cover having side edge, a top surface, a bottom surface and a first reversibly separable pad attached to said bottom surface;

said zipper pull cover being attached at said side edge to an inner surface of either of said front wall, back wall, first side wall and second side wall adjacent said openable end of said first zipper;

a second reversibly separable attachment pad attached to said upper surface of said mattress support panel adjacent said openable end of said first zipper; and whereby, when said first zipper is in a closed position, said first reversibly separable pad of said zipper pull cover will attach to said first securing tab and said second reversibly separable attachment pad, thereby preventing easy opening of said first zipper.

18. A portable combination bedside co-sleeper, as described in claim 15, further comprising a flexible covering for an upper portion of said first zipper to prevent injury to an infant or small child.

19. A portable combination bedside co-sleeper, as described in claim 18, wherein said mattress support panel further comprises:

a surrounding edge panel, said surrounding edge panel extending upwardly from said outer perimeter for a first predetermined distance and having an upper edge;

a second zipper, said second zipper removably attaching said surrounding edge panel to either of said front wall, said back wall, said first side wall and said second side wall at said upper edge; and whereby, when said second zipper attaches said upper edge to said front wall, said back wall, said first side;

wall and said second side wall said mattress support panel will be disposed on said first lower position, and when said first zipper also attaches said outer perimeter to said front wall, said back wall, said first side wall an said second side wall said mattress support panel will be disposed on said second higher position.

20. A portable combination bedside co-sleeper, as described in claim 19, further comprising means for securing an openable end of said second zipper.

21. A portable combination bedside co-sleeper, as described in claim 20, wherein said means for securing an openable end of said second zipper further comprises;

a second reversibly separable securing tab, said second securing tab attached to a zipper pull of said second zipper;

a zipper pull cover, said zipper pull cover having side edge, atop surface, a bottom surface and a first reversibly separable pad attached to said bottom surface;

said zipper pull cover being attached at said side edge to an inner surface of either of said front wall, back wall, first side wall and second side wall adjacent said openable end of said second zipper;

a third reversibly separable attachment pad attached adjacent said upper edge of said surrounding edge panel adjacent said openable end of said second zipper; and whereby, when said second zipper is in a closed position, said first reversibly separable pad of said zipper pull cover will attach to said second securing tab and said third reversibly separable attachment pad, thereby preventing easy opening of said second zipper.

22. A portable combination bedside co-sleeper, as described in claim 19, further comprising a flexible covering for upper portion of said second zipper to prevent injury to an infant or small child.

23. A portable combination bedside co-sleeper comprising:

a rigid enclosure having an open top, a floor, a front wall, a back wall, a first side wall, a second side wall and a mattress support panel;

said floor having a top surface, a bottom surface and surrounding side edges and being attached to said front wall, back wall, first side wall and second side wall at said surrounding side edges;

said mattress support panel having an upper surface, lower surface, an outer perimeter and being removably attached to said front wall, back wall, first side wall and second side wall at said outer perimeter and being spaced upwardly from said floor;

a mattress pad, said mattress pad having an upper surface, a lower surface and being sized and shaped to fit slidably between said front wall, back wall, first side wall and second side wall;

a rigid frame, said frame being formed at the top by front and rear upper parallel horizontal rails and first and second upper side horizontal rails and two upper front corner members and two upper rear corner members in cooperation therewith, and being formed adjacent said floor by front and rear lower parallel horizontal rails and first side and second side lower parallel horizontal rails and in cooperation therewith, and a pair of front vertical rails and a pair of rear vertical rails in further cooperation with said two upper front corner members and said two upper rear corner members and said four lower corner leg members;

said rigid frame supporting said floor, said front wall, said back wall, said first side wall and said second side wall;

each upper front corner member being constructed of two reversibly separable complementary sections, the first of said section being fixedly attached to an end of said front upper horizontal rail and the second of said sections being fixedly attached to an upper end of one of said front vertical rails, said upper front corner members supporting said upper front horizontal rail in a first position;

receiving means fixedly attached to each front vertical rail for receiving said first section of an upper front corner member and reversibly maintaining said upper front horizontal rail in at least one lower second position, thereby lowering said front wall and maintaining structural rigidity of the co-sleeper when said upper front horizontal rail is in one of said second positions; and a securing strap assembly for securing the co-sleeper to a parental bed;

whereby, when said upper front horizontal rail and said front wall are in the raised first position, the co-sleeper is usable as a bassinet; and wherein, when said upper front horizontal rail and said front wall are the lowered to one of said second positions, the co-sleeper is usable as a changing table; and further, when the securing strap assembly is properly positioned and the co-sleeper is secured to the parental bed it will serve as a co-sleeper;

wherein said front wall is comprised of flexible material and means for supporting said flexible material;

further comprising means for constraining a portion of said flexible material when said front wall is lowered from said first position at said top to one of said second positions below said top;

wherein said means for constraining a portion of said flexible material comprises:

a first strap portion, said first strap portion having first end and a second end and being attached at said first end to an inner surface of said front wall at a level below said at least one second position;

a receiving connector, said receiving connector being attached to said first strap portion at said second end;

a second strap portion, said second strap portion having a first end and a second end and being attached at said first end to an outer surface of said front wall at a level below said at least one second position;

an attaching connector, said attaching connector having a slot, said slot being sized and shaped to fit slidably over said second strap portion;

said second strap portion being looped through said slot of said attaching connector and removably attached to itself with a slidable adjusting buckle; and whereby, when said front wall is in one of said second positions and said attaching connector is disposed in said receiving connector, said slidable adjusting buckle may be moved to tighten said first and second strap portions so as to constrain said portion of said flexible material.

24. A portable combination bedside co-sleeper, as described in claim 23, further comprising:

an inside pocket, said inside pocket having a reversibly closable top opening and being disposed upon said inner surface of said front wall with said first end of said first strap portion attached to said front wall within said inside pocket;

an outside pocket, said outside pocket having a reversibly closable top opening and being disposed upon said outer surface of said front wall with said first end of said second strap portion attached to said front wall within said outside pocket; and whereby, when said first and second strap portions with attached receiving and attaching connectors are not needed to constrain said portion of said flexible said flexible material, said strap portions are stored within said inside and outside pockets, respectively.

25. A portable combination bedside co-sleeper comprising:

a rigid enclosure having an open top, a floor, a front wall, a back wall, a first side wall, a second side wall and a mattress support panel;

said floor having a top surface, a bottom surface and surrounding side edges and being attached to said front wall, back wall, first side wall and second side wall at said surrounding side edges;

said mattress support panel having an upper surface a lower surface, an outer perimeter and being removably attached to said front wall, back wall, first side wall and second side wall at said outer perimeter and being spaced upwardly from said floor;

a mattress pad, said mattress pad having an upper surface, a lower surface and being sized and shaped to fit slidably between said front wall, back wall, first side wall and second side wall;

a rigid frame, said frame being formed at the top by front and rear upper parallel horizontal rails and first and second upper side horizontal rails and two upper front corner members and two upper rear corner members in cooperation therewith, and being formed adjacent said floor by front and rear lower parallel horizontal rails and first side and second side lower parallel horizontal rails and in cooperation therewith, and a pair of front vertical rail and a pair of rear vertical rails in further cooperation with said two upper front corner members and said two upper rear corner members and said four lower corner leg members;

said rigid frame supporting said floor, said front wall, said back wall, said first side wall and said second side wall;

each upper front corner member being constructed of two reversibly separable complementary sections, the first of said sections being fixedly attached to an end of said front upper horizontal rail and the second of said sections being fixedly attached to an upper end of one of said front vertical rails, said upper front corner members supporting said upper front horizontal rail in a first position;

receiving means fixedly attached to each front vertical rail for receiving said first section of an upper front corner member and reversibly maintaining said upper front horizontal rail in at least one lower second position, thereby lowering said front wall and maintaining structural rigidity of the co-sleeper when said upper front horizontal rail is in one of said second positions;

a securing strap assembly for securing the co-sleeper to a parental bed; and whereby, when said upper front horizontal rail and said front wall are in the raised first position, the co-sleeper is usable as a bassinet; and wherein, when said upper front horizontal rail and said front wall are then lowered to one of said second positions, the co-sleeper is usable as a changing table; and further, when the securing strap assembly is properly positioned and the co-sleeper is secured to the parental bed it will serve as a co-sleeper;

wherein said mattress support panel further comprises means for removably securing said lower surface of said mattress pad to said upper surface of said mattress support panel;

wherein said mattress pad further comprises at least three portions, each of said portions having a rigid bottom section and a padded top section, said portions being hingedly attached to each other, means for removably attaching outer edges of said mattress pad together, and whereby, said mattress pad serves as an enclosure for the co-sleeper when folded for transport and storage;

wherein said mattress pad further comprises a slat-receiving pocket and a stiffening slat, said slat receiving pocket extending across said bottom sections of said at least three portions and being sized and shaped to receive said stiffening slat for further supporting said mattress pad.

* * * * *